US009739565B2

(12) United States Patent
Kielsmeier et al.

(10) Patent No.: US 9,739,565 B2
(45) Date of Patent: Aug. 22, 2017

(54) FOLDING STOCK

(71) Applicant: Magpul Industries Corp., Austin, TX (US)

(72) Inventors: Nicholas Kielsmeier, Denver, CO (US); Brian L. Nakayama, Arvada, CO (US); Michael T. Mayberry, Denver, CO (US); Timothy Eric Roberts, Broomfield, CO (US); William Bradley Bennett, Lafayette, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 15/273,008

(22) Filed: Sep. 22, 2016

(65) Prior Publication Data

US 2017/0010065 A1 Jan. 12, 2017

Related U.S. Application Data

(60) Continuation of application No. 14/639,778, filed on Mar. 5, 2015, now Pat. No. 9,488,434, which is a (Continued)

(51) Int. Cl.
*F41C 23/04* (2006.01)
*F41C 23/20* (2006.01)
(Continued)

(52) U.S. Cl.
CPC ..... *F41C 23/04* (2013.01); *F41C 23/02* (2013.01); *F41C 23/14* (2013.01); *F41C 23/20* (2013.01); *F41C 23/22* (2013.01)

(58) Field of Classification Search
CPC ..... F41C 23/04; F41C 23/14; F41C 23/20; F41C 23/22
(Continued)

(56) References Cited

U.S. PATENT DOCUMENTS 2,293,128 A 8/1942 Fortin
2,424,944 A 2/1944 Patchett
(Continued)

FOREIGN PATENT DOCUMENTS

CA 2696960 C 1/2015
EP 1751488 A1 2/2007
(Continued)

OTHER PUBLICATIONS

Cooper, John, "US Office Action re U.S. Appl. No. 14/577,914", Mar. 16, 2015, p. 17, Published in: US.
(Continued)

*Primary Examiner* — John D Cooper
(74) *Attorney, Agent, or Firm* — Neugeboren O'Dowd PC

(57) ABSTRACT

A stock and related methods for a firearm are disclosed. An exemplary stock includes a distal portion for interfacing with a firearm, the distal portion having one of a lock catch or a lock and one of a detent or a detent notch distinct from the one of a lock catch or a lock. The exemplary stock further includes a proximal portion, the proximal portion having the other one of a lock catch or a lock and the other one of a detent or a detent notch. The exemplary stock has a folded configuration and an unfolded configuration. The exemplary lock is shaped to engage the lock catch to selectively maintain the stock in the unfolded configuration. The exemplary detent is shaped to engage the detent notch to selectively maintain the stock in the folded configuration.

18 Claims, 30 Drawing Sheets

Related U.S. Application Data division of application No. 14/577,914, filed on Dec. 19, 2014, now Pat. No. 9,228,795.

(51) Int. Cl.
*F41C 23/14* (2006.01)
*F41C 23/22* (2006.01)
*F41C 23/02* (2006.01)

(58) Field of Classification Search
USPC ..... 42/75.01, 75.03, 75.1, 71.01, 72, 73; 89/158
See application file for complete search history.

(56) References Cited

U.S. PATENT DOCUMENTS 2,374,621 A 4/1945 Reising
2,405,758 A * 8/1946 Sampson ..... F41C 23/04 42/72
2,437,548 A * 3/1948 Patchett ..... F41A 11/04 42/72
2,462,091 A * 2/1949 Garand ..... F41C 23/04 42/72
3,201,887 A 8/1965 Sedelow
3,256,632 A 6/1966 Beretta
3,369,316 A * 2/1968 Miller ..... F41C 23/04 42/72
4,383,384 A * 5/1983 Fox ..... F41C 23/04 42/72
4,689,908 A * 9/1987 McClellan ..... F41C 23/10 224/198
4,691,462 A * 9/1987 Mattarelli ..... F41C 7/11 42/73
5,173,564 A * 12/1992 Hammond, Jr. ..... F41C 23/00 42/75.03
5,209,215 A 5/1993 Morrison
6,374,528 B1 * 4/2002 Davis ..... F41C 23/00 42/71.01
6,591,533 B2 * 7/2003 Wygant ..... F41C 23/04 16/327
6,820,361 B2 11/2004 Popikow
6,901,691 B1 * 6/2005 Little ..... F41A 23/02 42/118
7,024,812 B2 * 4/2006 Nelson ..... F41G 1/00 42/73
7,162,822 B1 * 1/2007 Heayn ..... F41C 23/04 42/71.01
7,162,823 B2 * 1/2007 Schoppman ..... F41A 11/04 42/75.01
7,398,616 B1 7/2008 Weir
7,552,557 B1 6/2009 Mabry
7,673,412 B2 3/2010 Griffin
7,739,821 B1 6/2010 Hamme
7,823,315 B2 * 11/2010 Webber ..... F41A 11/02 42/71.01
7,827,721 B2 11/2010 Griffin
7,984,580 B1 * 7/2011 Giauque ..... F41C 23/06 42/73
8,051,593 B2 11/2011 Vesligai
8,051,594 B2 11/2011 Carr et al.
8,109,026 B1 2/2012 Bentley et al.
8,196,328 B2 6/2012 Simpkins
8,286,382 B2 10/2012 Vesligai
8,312,661 B2 * 11/2012 Ludlow ..... F41C 23/04 42/73
8,429,844 B2 * 4/2013 Dextraze ..... F41A 3/18 42/73
8,448,366 B2 5/2013 Faifer
8,464,458 B2 6/2013 Chvala
8,522,465 B2 9/2013 Jarboe et al.
8,631,601 B2 1/2014 Langevin et al.
8,656,623 B1 * 2/2014 Chvala ..... F41C 23/04 42/73
8,671,608 B2 * 3/2014 Vesligaj ..... F41C 23/04 42/73
8,671,609 B2 3/2014 Fonte
8,720,099 B1 * 5/2014 Sisk ..... F41C 23/14 42/73
8,756,849 B2 6/2014 Troy
8,769,854 B1 * 7/2014 Battaglia ..... F41A 3/66 42/71.01
8,769,855 B2 * 7/2014 Law ..... F41C 23/14 42/73
8,819,981 B2 9/2014 Malik et al.
8,950,099 B2 2/2015 Rogers et al.
8,978,285 B1 * 3/2015 Burke ..... F41C 23/14 42/73
8,991,088 B1 * 3/2015 Young ..... F41A 25/00 42/75.03
9,091,505 B1 * 7/2015 Battaglia ..... F41C 23/20
9,121,663 B2 9/2015 Troy et al.
2005/0215092 A1 * 9/2005 Schoppman ..... F41A 11/04 439/101
2005/0268516 A1 * 12/2005 Nelson ..... F41G 1/00 42/73
2007/0214697 A1 * 9/2007 Ochoa ..... F41C 23/14 42/73
2008/0028662 A1 * 2/2008 Abraham ..... F41C 23/14 42/73
2009/0019757 A1 * 1/2009 Moretti ..... F41A 3/66 42/75.03
2009/0139128 A1 6/2009 Fluhr
2009/0288324 A1 * 11/2009 Peterson ..... F41A 11/02 42/75.03
2010/0205846 A1 8/2010 Fitzpatrick et al.
2010/0242333 A1 9/2010 Kincel
2010/0307042 A1 * 12/2010 Jarboe ..... F41A 3/18 42/6
2011/0131857 A1 * 6/2011 Kuczynko ..... F41A 3/84 42/73
2012/0144712 A1 * 6/2012 Rostocil ..... F41A 9/79 42/16
2012/0159828 A1 * 6/2012 Jarboe ..... F41A 3/18 42/16
2012/0180354 A1 * 7/2012 Sullivan ..... F41A 3/26 42/16
2012/0260793 A1 10/2012 Gomez
2013/0036645 A1 * 2/2013 Chvala ..... F41C 23/04 42/73
2013/0097911 A1 * 4/2013 Larue ..... F41C 23/04 42/73
2013/0180148 A1 7/2013 Rogers et al.
2014/0075815 A1 * 3/2014 Jarboe ..... F41C 23/04 42/73
2014/0190056 A1 7/2014 Troy et al.
2014/0196344 A1 7/2014 Malik et al.
2014/0196346 A1 * 7/2014 Grimshaw ..... F41C 23/04 42/73
2014/0360074 A1 12/2014 Jarboe
2015/0345895 A1 * 12/2015 Young ..... F41A 11/04 42/71.01
2016/0084606 A1 3/2016 Michal
2016/0116250 A1 * 4/2016 Mather ..... F41A 3/66 42/73

FOREIGN PATENT DOCUMENTS

EP 2069705 A2 6/2009
EP 2389558 B1 1/2016
WO 2005124265 A1 12/2005
WO 2006042677 A1 4/2006
WO 2006115703 A2 11/2006
WO 2012050670 A2 4/2012

OTHER PUBLICATIONS

Schneider, Laura A., "Response to Office Action re U.S. Appl. No. 14/577,914", Jun. 15, 2015, p. 17, Published in: US.

(56) References Cited

OTHER PUBLICATIONS

Young, Lee W., "International Search Report and Written Opinon re Application No. PCT/US15/66484", Mar. 3, 2016, p. 11, Published in: US.
Cooper, John, "Office Action re U.S. Appl. No. 14/639,778", Apr. 7, 2016, p. 43, Published in: US.
Schneider, Laura A., "Response to Office Action re U.S. Appl. No. 14/639,778", Apr. 28, 2016, p. 14, Published in: US.
Tapco, Inc., "AK Folding Stock—Black", Retrieved from http://www.tapco.com/products/ak/index.php?_a=viewProd &productId=414, Known to exist as early as Feb. 24, 2015, p. 1, Published in: US.
Promag, "AA123—Archangel Opfor AK-Series (4) Position Adjustable Butt-Stock, with Recoil Pad", Retrieved from https://promagindustries.com/ak-47-variants/49-archangel-opfor-ak-series-4position-adjustable-butt-stock-with-recoil-pad.html, Known to exist as early as Dec. 26, 2013, Published in: US.
The Mako Group, "Folding, Collapsible Buttstock System for AK-47/74—Polymer Joint", Retrieved from http://www.themakogroup.com/Detail.aspx?PROD=1044490&CAT=8674, Known to exist as early as Feb. 24, 2015, p. 2, Published in: US.
The Mako Group, "Tactical Folding Buttstock w/Cheekpiece & Steel Galil Hinge for AK-47/74", Retrieved from http://www.themakogroup.com/Detail.aspx?PROD=1044518&CAT=8674, Known to exist as early as Feb. 24, 2015, p. 2, Published in: US.
The Mako Group, "Tactical Folding Buttstock w/Cheekpiece for AK-47/74—Polymer Joint", Retrieved from http://www.themakogroup.com/Detail.aspx?PROD=1044521&CAT=8674, Known to exist as early as Feb. 24, 2015, p. 2, Published in: US.
Ahn, Jae Yul, "International Search Report re Application No. PCT/US2013/069964", Feb. 26, 2014, p. 3, Published in: KR.
Pyramid Airsoft, "SRC XR8-2 AEG airsoft Rifle Owner's Manual", Retrieved from http://www.pyramidairsoft.com/manual/SRC-XR8-2-AEG/SRC-XR8-2-AEG.htm, Known to exist as early as Feb. 24, 2015, p. 6, Published in: US.
Wikipedia, "XM8 Rifle", Retrieved from http://en.wikipedia.org/wiki/XM8_rifle, Known to exist as early as May 4, 2015, p. 7, Published in: US.
Cheaper Than Dirt, "ATI AK-47 Adjustable Side Folding Strikeforce Stock Package Polymer Black A.2.10.1250" Retrieved from http://www.cheaperthandirt.com/product/85635, Known to exist as early as May 4, 2015, p. 2, Published in: US.

* cited by examiner

FOLDING STOCK

CROSS REFERENCE TO RELATED APPLICATIONS

This application is a continuation of U.S. patent application Ser. No. 14/639,778 filed Mar. 5, 2016 and entitled STOCK-FIREARM INTERFACE, which is a divisional of U.S. patent application Ser. No. 14/577,914 filed Dec. 19, 2014 and entitled STOCK FOR A FIREARM, the entire disclosure of which is hereby incorporated by reference for all purposes, as if fully set forth herein.

COPYRIGHT

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates to firearms. In particular, but not by way of limitation, the present invention relates to systems and methods for using a firearm stock assembly.

BACKGROUND OF THE INVENTION

A number of firearm designs have been developed over the years. Over time, a number of countries and manufacturers have developed a variety of manufacturing tolerances for firearms based off of the same design. For example, the AK-47 style firearm has been manufactured and in use around the world for over half a century, and, although similar patterns are used for manufacture, diverging manufacturing tolerances exist, depending on the country of origin and/or year of design. Therefore, components manufactured by a first manufacturer often do not properly fit components manufactured by a second manufacturer, despite purportedly being of the same design or pattern.

In another typical firearm design, a folding stock assembly is provided. The folding stock assembly in many designs requires the user translate the folding stock along an axis prior to and/or during rotation about that axis (e.g., a vertical axis). Requiring the user translate the stock on the axis reduces the reliability of the weapon itself and increases the complexity of use of the weapon.

In another example, a folding stock generally has a folded configuration and an unfolded configuration, with the same locking mechanism being used to selectively maintain the stock assembly in the folded and unfolded configurations. Using the same lock for maintaining both configurations limits the freedom of the designer to control folding and unfolding forces.

In another example, when a user improperly applies a folding force to a folding stock assembly without disengaging a lock, the user may break the folding stock.

In another example, when a cheek riser is used and a user fires a weapon with a folding stock in the folded position, the charging handle may strike the cheek riser causing the cheek riser and/or a body of the folding stock itself to break.

In another example, firearms having a quick detach mechanism often experience a concentration of forces at the quick detach mechanism, thus leading to early failure of the quick detach mechanism.

In still another example, firearms having a length of pull adjustment feature generally require the user undergo a relatively cumbersome step to adjust the length of pull—often requiring a "third hand". In such designs, the user must depress or pull a catch or spring in a transverse direction while pulling or pushing the buttstock in a lateral direction to adjust the length of pull.

Accordingly, a system and method is desired to address one or more of the shortfalls of present technology discussed above, and/or to provide other new and innovative features.

SUMMARY OF THE INVENTION

The present invention can provide a system or method for using a stock assembly for a firearm.

In one example, an exemplary stock includes a distal portion for interfacing with a firearm, the distal portion having one of a lock catch or a lock and one of a detent or a detent notch distinct from the one of a lock catch or a lock. The exemplary stock further includes a proximal portion, the proximal portion having the other one of a lock catch or a lock and the other one of a detent or a detent notch. The exemplary stock has a folded configuration and an unfolded configuration. The exemplary lock is shaped to engage the lock catch to selectively maintain the stock in the unfolded configuration. The exemplary detent is shaped to engage the detent notch to selectively maintain the stock in the folded configuration.

In another example, an exemplary method of using a stock for a firearm includes moving the stock between a folded configuration and an unfolded configuration; causing a detent to engage a detent notch to selectively maintain the stock in the folded configuration; and causing a lock to engage a lock catch to selectively maintain the stock in the unfolded configuration, the lock and the lock catch distinct from the detent and the detent catch.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings wherein:

DETAILED DESCRIPTION

Prior to describing the embodiments in detail, some terms as to be understood in this document shall first be defined. For the purpose of this document, the terms "top", "bottom", "vertical", and "horizontal" shall be understood to reference orientation of components relative to a firearm that is held such that the barrel is horizontal to ground, and rotated such that a firing grip is not rotated to a left or a right when viewed from directly behind the weapon. For example, in FIG. 2, the stock assembly and the weapon's iron sights are on a top of the stock 10. The term "distal" shall be understood to reference those components or a direction approaching the end of a firearm from which rounds leave when fired, or furthest from a buttpad of an unfolded weapon. The term "proximal" shall be understood to reference those components or a direction opposing the distal end. For example, in FIG. 2, the stock 10 is attached at a proximal end of the weapon and the folding stock 104 has been rotated such that the buttstock 1044 is distal of the stock-to-firearm interface 102.

Figure 1:
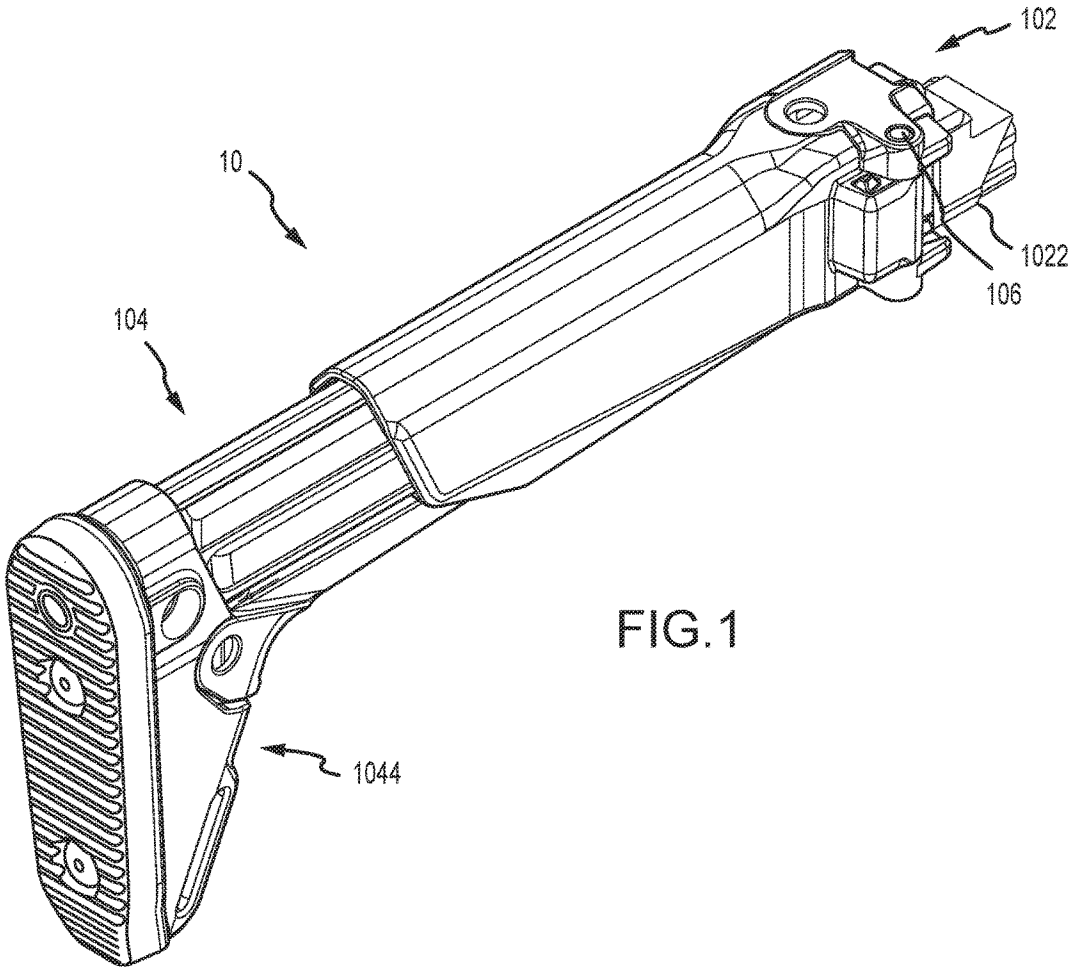
FIG. 1 is an isometric view of a stock assembly according to an embodiment.

Referring now to the drawings, where like or similar elements are designated with identical reference numerals throughout the several views, FIG. 1 illustrates an isometric view of a stock assembly 10 for a firearm, according to an embodiment.

Figure 2:
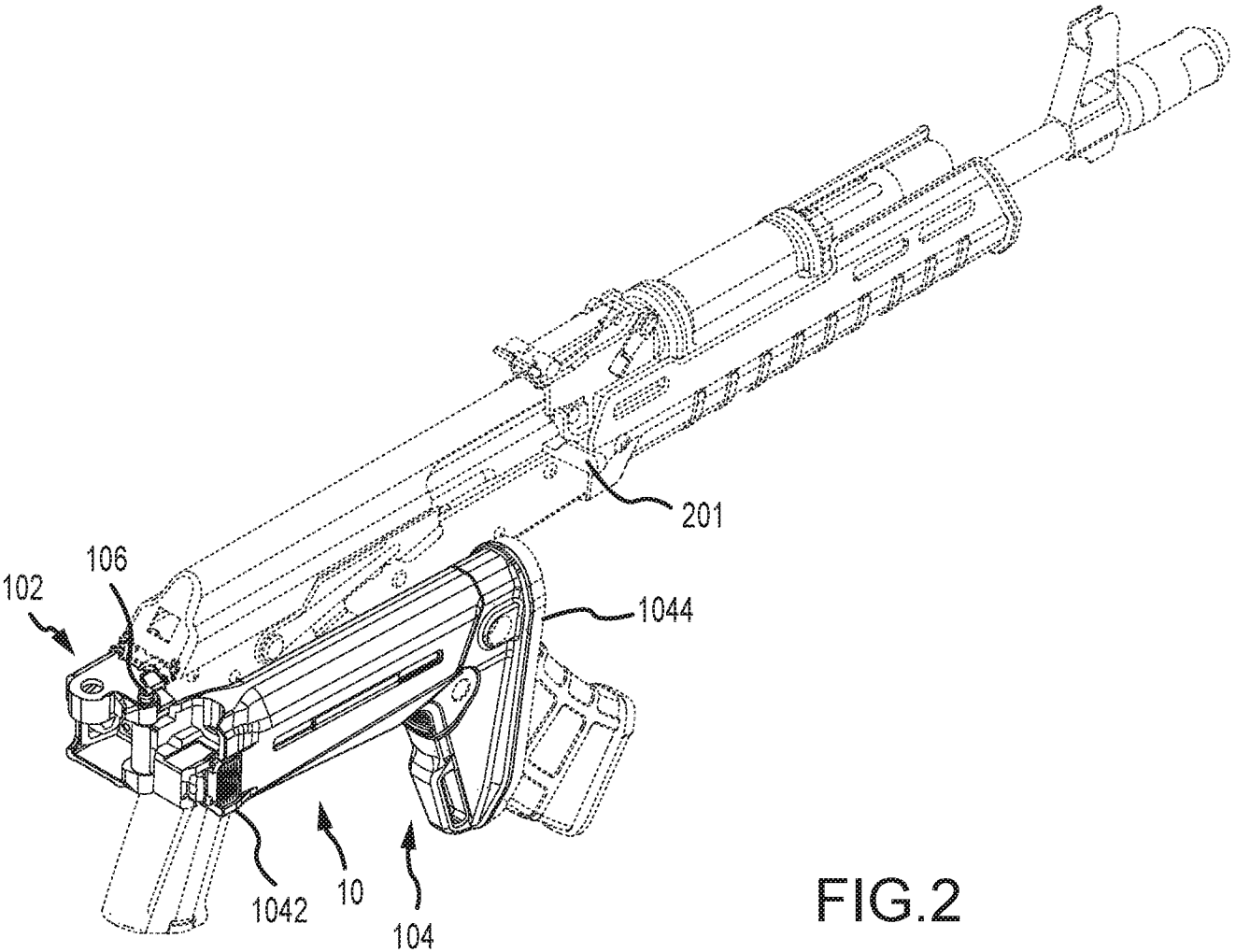
FIG. 2 is an isometric view of a stock assembly attached to a firearm in the folded position.

As seen, the stock 10 has a stock-to-firearm interface 102 for mounting the stock 10 to a firearm (not shown), and a folding stock assembly 104 hingedly coupled to the stock-to-firearm interface 102. The folding stock assembly 104 is shaped to rotate about a hinge 106 relative to the stock-to-firearm interface 102, toward a side of the firearm, such that the stock 10 can be folded into a folded configuration, as shown in FIG. 2. While the illustrated stock 10 folds to a right side of the firearm, in an alternative embodiment the stock 10 can fold to a left side of the firearm. With reference to both FIG. 1 and FIG. 2, the hinge 106 and/or the stock-to-firearm interface 102 may be shaped to limit rotation of the folding stock assembly 104 to rotational movement about the hinge 106. That is, the folding stock assembly 104 may be expressly blocked from translational (e.g., vertical) movement relative to the hinge 106 as the stock 10 is moved between an unfolded configuration, seen in FIG. 1, and a folded configuration, seen in FIG. 2, thus improving the reliability of the stock 10 and/or the ease of use, by eliminating one step, translation along a hinge axis, for the user, as compared to other folding stock assemblies known in the industry.

Figure 3A:
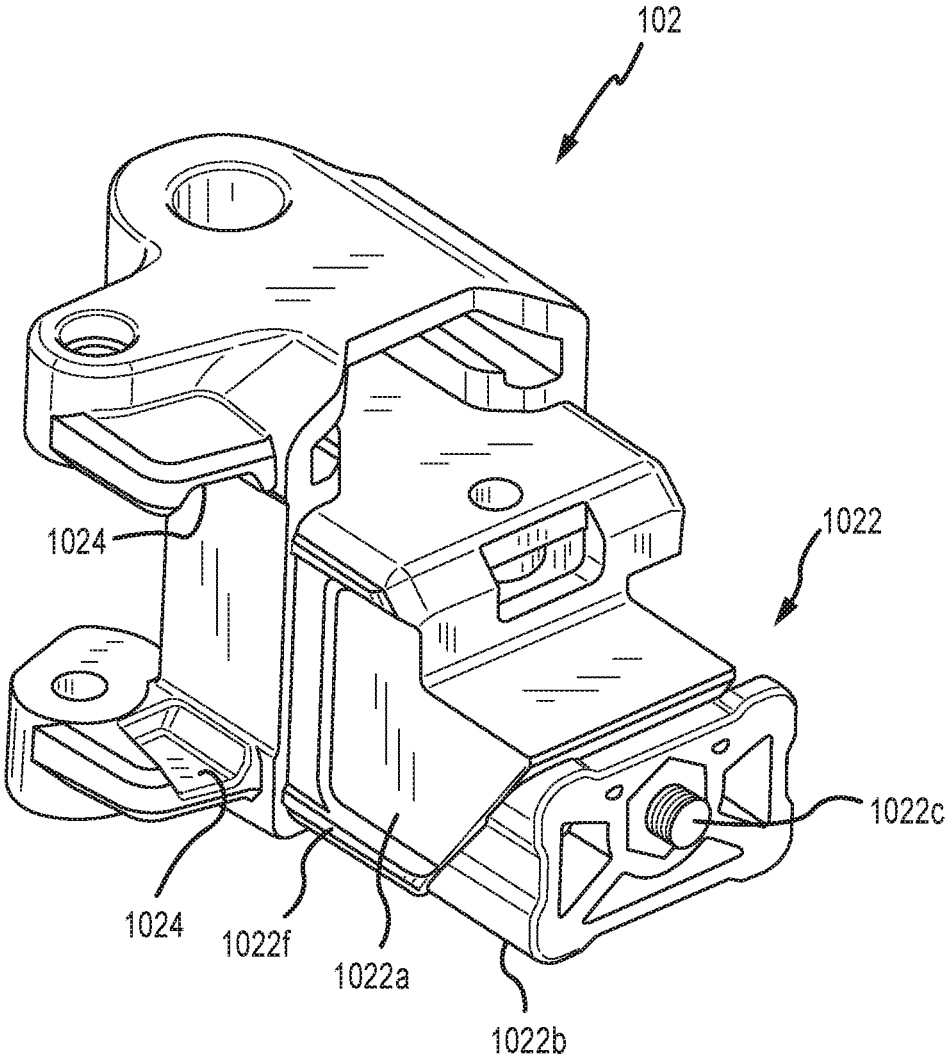
FIG. 3A is an isometric view of a stock-to-firearm interface according to an embodiment.

With reference now to FIGS. 3A-3E, the stock-to-firearm interface 102 is now discussed in further detail. The stock-to-firearm interface 102 has a modifiable firearm mount 1022 (see FIG. 3A), at least one detent notch 1024, a quick detach mount 1026 (see FIG. 3C), and a lock catch 1028 (see FIGS. 3D-3E). In some embodiments, two opposing detent notches 1024 are provided, as seen in FIG. 3A, for ensuring an even distribution of forces as the stock 10 is folded or unfolded.

Figure 3B:
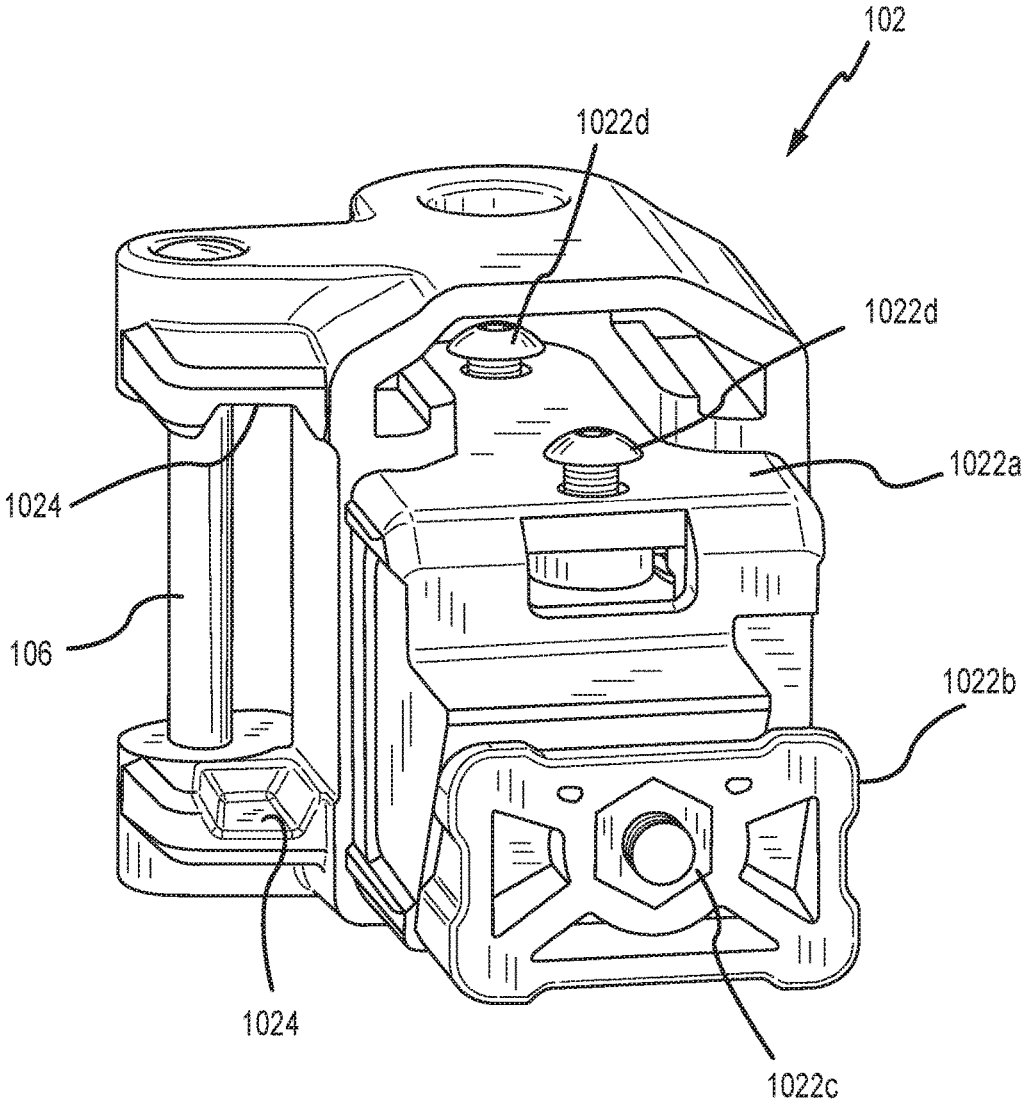
FIG. 3B is a three dimensional view of a stock-to-firearm interface according to an embodiment.

As seen in FIGS. 3A-3B, the stock-to-firearm interface 102 has a modifiable firearm mount 1022 and a detent notch 1024. The modifiable firearm mount 1022 may have a primary mount body 1022*a*. A distal portion of the primary mount body 1022*a* may be shaped to fit within a recess of a receiver of a firearm (e.g., an AK-47 style firearm), while a proximal portion of the primary mount body 1022*a* may be operatively coupled to a hinge portion of the stock-to-firearm interface 102, or, as shown in FIG. 3A, the primary mount body 1022*a* may be unitary with a proximal portion of the stock-to-firearm interface 102, with the proximal portion providing a hinging mount for the folding stock assembly 10, such as at hinge 106 shown in FIG. 3B. The modifiable firearm mount 1022 may also include one or more fasteners 1022*d*, most clearly seen in FIG. 3B, for mounting the stock-to-firearm interface 102 to the folding stock assembly 104. The one or more fasteners 1022*d* can include one or more of the following: screws, bolts, clips, nuts, etc. The primary mount body 1022*a* may function substantially as is known in the art for mounting a stock assembly to a firearm, such as an AK-47 style firearm.

The modifiable firearm mount 1022 may also have a modifier body 1022*b* and a fastener 1022*c* adjustably coupling the primary mount body 1022*a* and the modifier body 1022*b*. The modifier body 1022*b* is shaped to fit wholly within a recess of a receiver of a firearm, and is shaped so as to adjust to fit different sized recesses of a firearm receiver. A proximal surface of the modifier body 1022*b* may be shaped to substantially abut a distal surface of the primary mount body 1022*a*, and the fastener 1022*c* may be a screw or other threaded fastener extending longitudinally through both the primary mount body 1022*a* and the modifier body 1022*b*, such that adjustment of the fastener 1022*c* and/or the modifier body 1022*b* adjusts a maximum profile Pmax (see e.g. FIG. 11A) defined by the primary mount body 1022*a* and the modifier body 1022*b*. Adjustment of the modifier body 1022*b* relative to the primary mount body 1022*a* allows a user or manufacturer to adjust the overall vertical width of engagement between a firearm and the modifiable firearm mount 1022, and overcomes the problems in the art of manufacturing tolerance variance between different manufacturers in various countries.

Continuing with FIGS. 3A-3B, the modifier body 1022*b* may have a wide first portion tapering to a narrow second portion, with the wide first portion shaped to engage a first interior wall of the receiver (e.g., a bottom interior of a recess of a receiver). In some embodiments, the narrow second portion is shaped to engage a second interior wall of the receiver, the second interior wall opposing the first interior wall, although in many cases, a majority of the narrow second portion will not contact an inner surface of a recess of a firearm receiver. It should be understood that, although the figures depict the modifier body 1022*b* as having a wide bottom portion, a wide top portion could be applied.

Continuing still with FIG. 3A, the modifiable firearm mount 1022 may have one or more adjustment ridges 1022*f*. These adjustment ridges 1022*f* may be relatively small ridges along the distal portion of the primary mount body 1022*a*, and may be oversized prior to assembly to a firearm. Specifically, the adjustment ridges 1022*f* may be sized to ensure an overall transverse width of the primary mount body 1022*a* is wider than most or all receiver recesses associated with a particular line of weapon, such as the AK-47 style weapon. Prior to assembly, a user or manufacturer may file, shave, or otherwise reduce a size of an adjustment ridge 1022*f*, thereby reducing an effective width of the primary mount body 1022*a*, to ensure a tight fit between the modifiable firearm mount 1022 and a recess in the firearm. In some embodiments, the primary mount body 1022*a* may be made primarily of a polymeric material, thus improving the fit between the modifiable firearm mount 1022 and the recess of the firearm, which may be an AK-47 style firearm. One advantage of using a polymeric material is that the adjustment ridge 1022*f* can compress, bend, or otherwise deform when the modifiable firearm mount 1022 is inserted into a recess of a firearm, thereby forming a tighter fit than could be achieved with a primary mount body 1022*a* formed of a more rigid material such as aluminum or steel.

Turning now to FIG. 3B, the hinge 106 may be vertical in some embodiments. However, in some embodiments, the hinge 106 may be tilted relative to a vertical axis to limit the potential for interference with other parts of the firearm when the stock 10 is folded. In some embodiments, the hinge 106 is tilted about 1 degree from a vertical axis. In some embodiments the hinge 106 is tilted about 4 degrees from a vertical axis. In some embodiments, the hinge 106 is tilted between 0 degrees and about 5 degrees from a vertical axis.

Figure 3C:
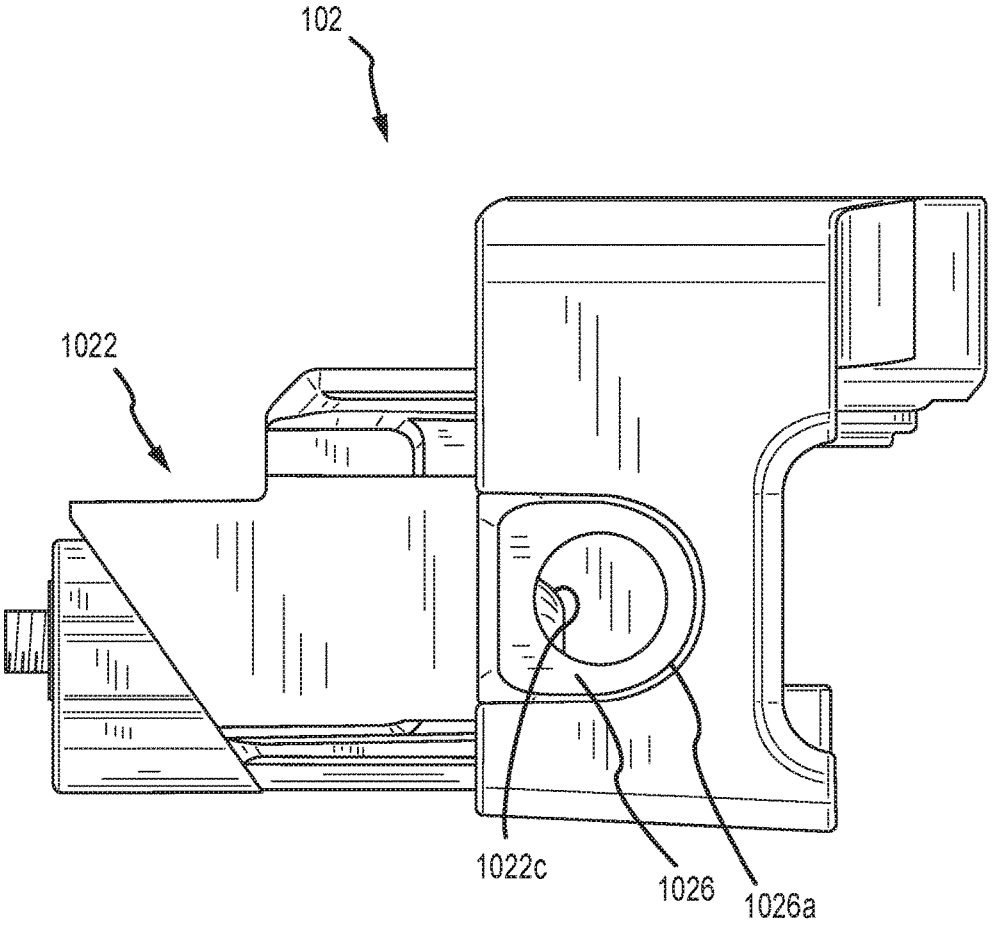
FIG. 3C is a side view of a stock-to-firearm interface according to an embodiment.
Figure 3D:
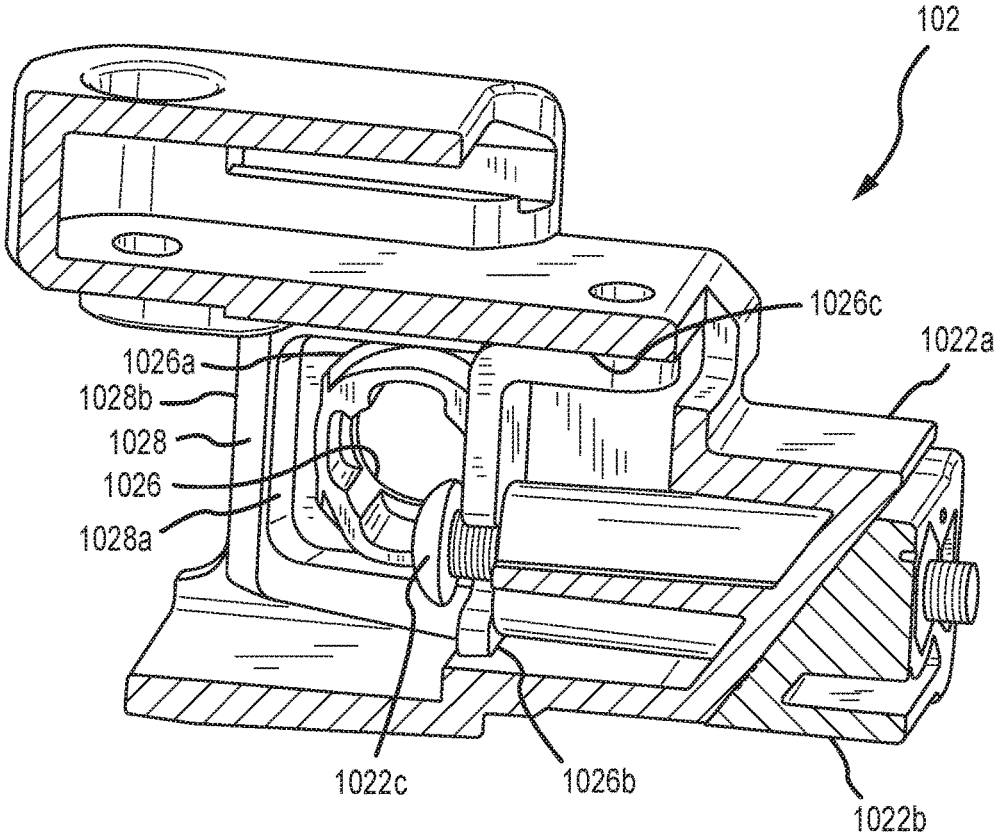
FIG. 3D is a side section view illustrating some components of a stock-to-firearm interface according to an embodiment.
Figure 4:
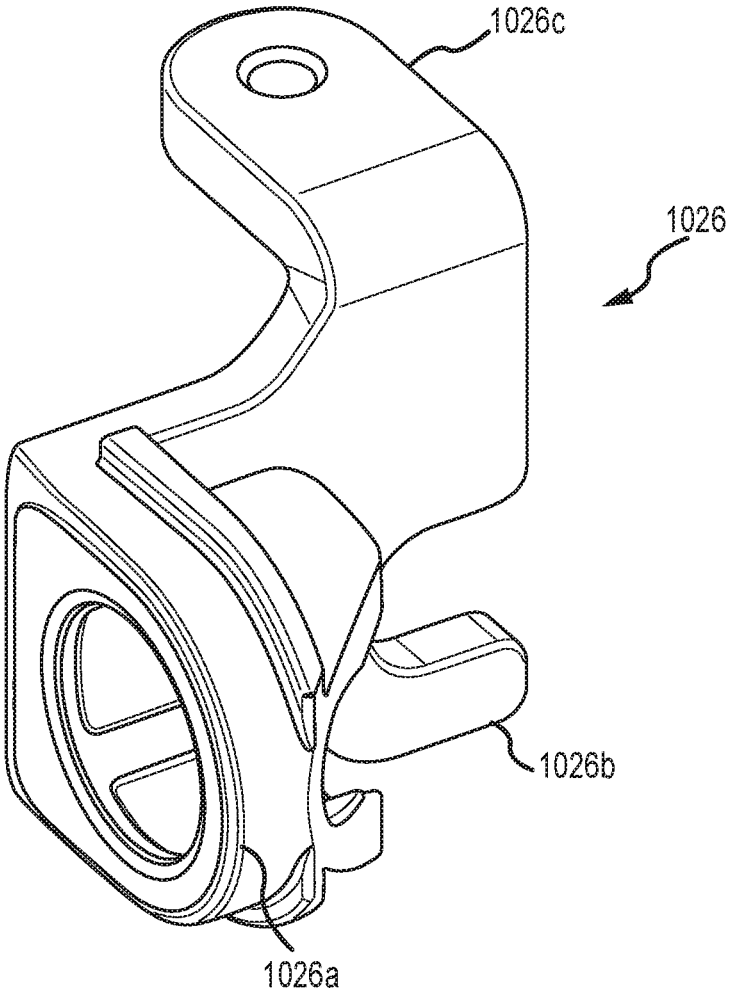
FIG. 4 is an isometric view of a quick detach mount according to an embodiment.

Turning now to FIGS. 3C and 4, the stock-to-firearm interface 102 also has a quick detach mount 1026. Specifically, one may use the quick detach mount 1026 and one or more optional recesses 1044*a* (shown in FIG. 5) in the buttstock 1044 for quickly attaching and detaching items, such as slings, to a firearm. In the embodiment shown in FIGS. 3C, 3D, and 4, a quick detach mount 1026 may be provided that is shaped to distribute a carry force between a first surface of the stock-to-firearm interface and at least one of a second surface of the stock-to-firearm interface 102 and a firearm directly, such as a recess in the receiver of the firearm. More specifically, the quick detach mount 1026 may comprise one or more arms that extend from a mounting face of the quick detach mount 1026 (see FIG. 4), with the arms shaped or curved to attach to another surface, which may be a second surface of the stock-to-firearm interface 102 or the receiver directly. In some embodiments, the carry force is the force imposed by a male portion of a quick detach interface attached to a sling for carrying the weapon.

For example, as seen in FIG. 3D, a first engagement surface 1026*a* of the quick detach mount 1026 may engage a first inner surface of the stock-to-firearm interface 102, while a second engagement surface 1026*b* may engage a second inner surface of the stock-to-firearm interface 102, as seen in FIG. 3D, and/or a third engagement surface 1026*c* may engage a third inner surface of the stock-to-firearm interface 102. The quick detach mount 1026 is shown isolated in FIG. 4 for clarity. Although the third engagement surface 1026*c* is shown in FIG. 3D in engagement with the stock-to-firearm interface 102, the third engagement surface 1026*c* and/or the second engagement surface 1026*b* may be shaped to engage the receiver directly, such as, in one non-limiting example, by extending through one or more walls of the primary mount body 1022*a*.

The quick detach mount 1026 illustrated in FIG. 3D may be shaped to abut a third surface of the stock-to-firearm interface 102 such that a fastener attaching the primary mount body 1022*a* to a receiver of a firearm may also be used to attach the quick detach mount 1026 to the primary mount body 1022*a*. In some embodiments, the quick detach mount 1026 may be shaped to engage the receiver directly, as described in the preceding paragraph. In some embodiments, when the quick detach mount 1026 is shaped to engage the receiver directly, a fastener may be used to permanently or removably attach, such as through bolting or screwing, the quick detach mount 1026 to the receiver.

In some embodiments, the quick detach mount 1026 may be shaped to allow engagement with the fastener 1022*c* such that the quick detach mount 1026 and all components in the modifiable firearm mount 1022 (1022*a*, 1022*b*) are rigidly fastened together, as shown in FIG. 3D. Construction in this manner allows for a distribution of forces from the quick detach mount 1026 through the modifiable firearm mount 1022 to the receiver of the firearm, thus improving the reliability of the quick detach mount 1026 by reducing the chances of the quick detach mount 1026 breaking from the stock 10 under excessive force.

In some embodiments, the quick detach mount 1026 provides a plurality of force distribution surfaces at a plurality of surfaces, such as a first engagement surface 1026*a*, a second engagement surface 1026*b*, a third engagement surface 1026*c*, and a fourth engagement surface 1026*d* (see FIG. 3E), wherein an average surface normal of each surface 1026*a*, 1026*b*, 1026*c*, 1026*d* is in a different direction, and each engagement surface is directly engaged with a corresponding engagement surface of a firearm receiver and/or a stock-to-firearm interface 102.

In some embodiments, the quick detach mount 1026 is manufactured of a high strength material such as a metallic material, while the majority of the other components of the stock 10 are manufactured of polymeric materials. Because the quick detach mount 1026 includes appendages that extend out in multiple directions through an inside of the modifiable firearm mount 1022 and couple to the inside of the modifiable firearm mount 1022 at different locations, the use of a rigid material such as a metal provides the added advantage of forming a rigid skeleton for the modifiable firearm mount 1022. While other prior art stocks have included accessory mounts, the present disclosure provides a quick detach mount 1026 that functions to not only interface accessories to the stock but also to provide enhanced structural rigidity for the stock 10, especially near the hinge where high stresses are seen. Both of these functions are achieved via a single component, thus lowering costs and simplifying manufacturing.

Figure 3E:
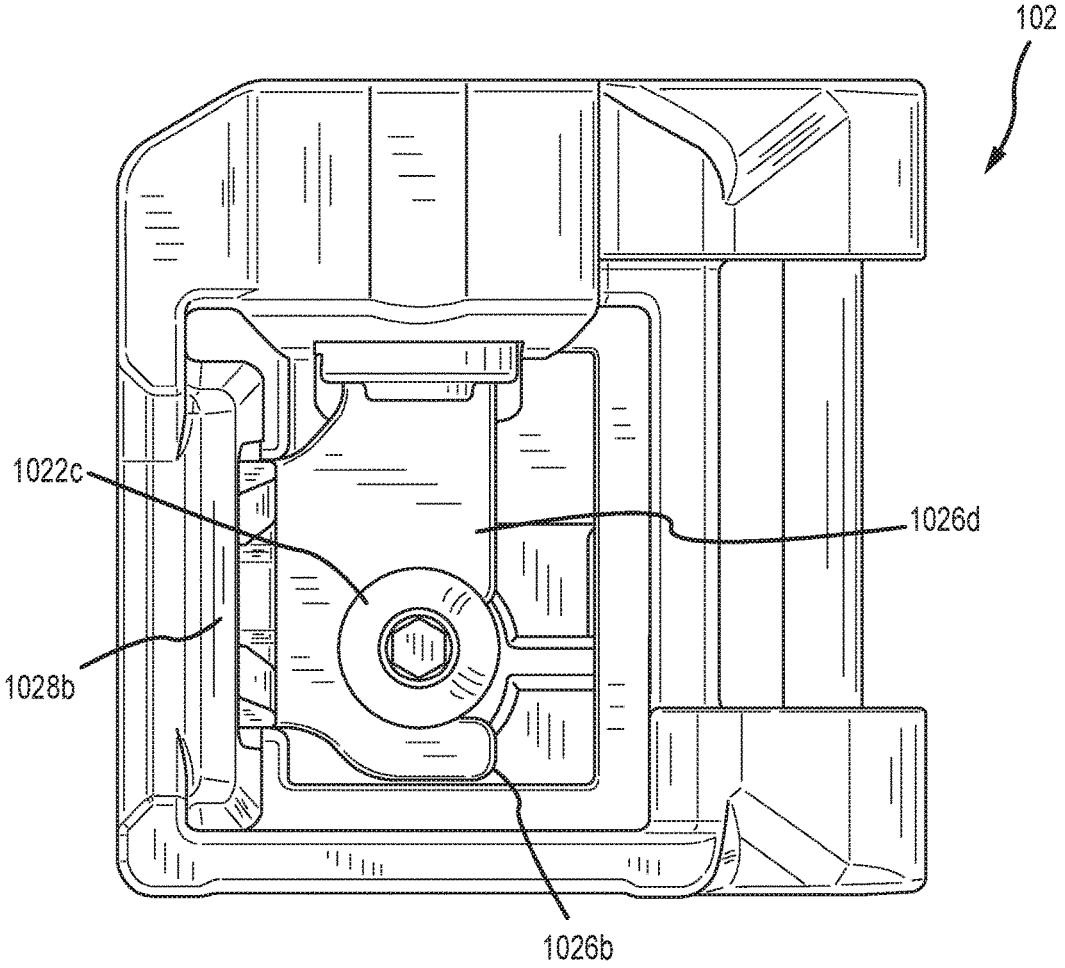
FIG. 3E is a front view of some components of a stock-to-firearm interface according to an embodiment.

As shown in FIGS. 3D-3E and previously mentioned, the stock-to-firearm interface 102 also includes a lock catch 1028. The lock catch 1028 may have an inwardly projecting ridge with a surface, such as a distal surface 1028*a* for engaging a lock 1042 (seen in FIG. 2) in the folding stock assembly 104. The details of the lock 1042 and lock catch 1028 will be discussed in further detail in subsequent sections of this document after describing details of the folding stock assembly 104.

Figure 5:
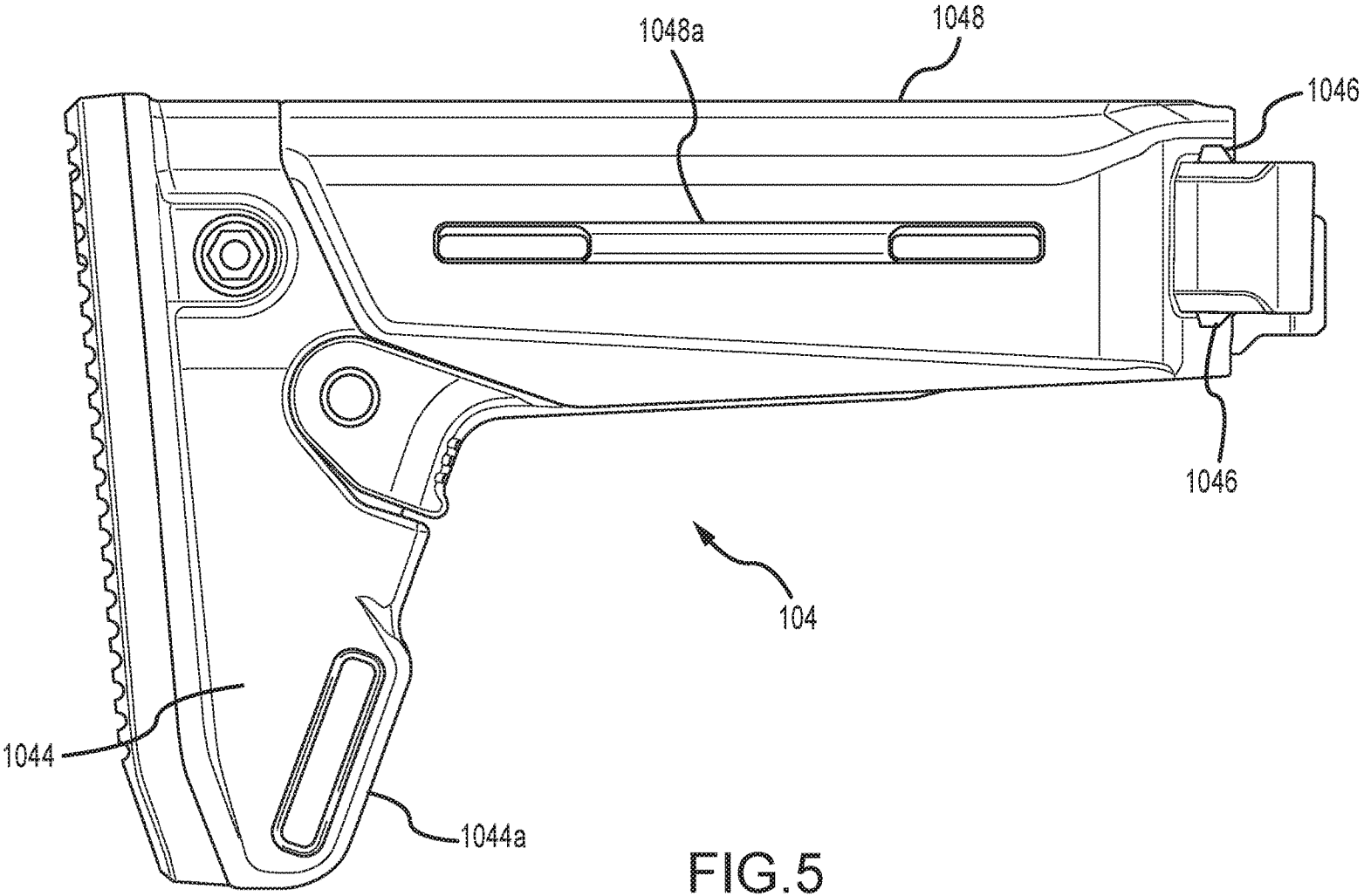
FIG. 5 is a side view of a folding stock assembly according to an embodiment.

Turning now to FIG. 5, the folding stock assembly 104 comprises a buttstock 1044, and at least one detent 1046 to engage at least one detent notch 1024 (see FIG. 3A) in the stock-to-firearm interface 102 to selectively maintain the stock 10 in the folded configuration. The folding stock assembly 104 also has a lock 1042 (see FIG. 2) for engaging the lock catch 1028 (see FIG. 3D) in the stock-to-firearm interface 102 to selectively maintain the stock 10 in the unfolded configuration. In other words, the stock 10 uses a first feature (e.g., lock 1042 and lock catch 1028) for locking the stock 10 in an unfolded configuration, and uses a second feature (e.g., detent 1046 and detent notch 1024) for locking the stock 10 in a folded configuration.

The detent 1046, shown in FIG. 5, may be one or more spring-biased tabs that are forced into a retracted position as the folding stock assembly 104 is folded towards the stock-to-firearm interface 102, and, when the stock 10 reaches a completely folded configuration, the tabs may be biased out into at least one detent catch 1024, most clearly seen in FIG. 3B. When engaged with the detent catch 1024, the detent 1046 helps to maintain the stock 104 in the folded configuration. When sufficient unfolding moment or torque is placed on the folding stock assembly 104 to overcome the engagement of the detent(s) 1046 and the detent catch(es) 1024 (e.g., compressing the detent 1046 sufficiently to allow the detent 1046 to laterally rotate out of the detent catch 1024), the folding stock assembly 104 can be unfolded. The detent 1046 may be a spring-biased translational detent for engaging a detent catch 1024.

The use of a detent 1046 for selectively maintaining the stock 10 in a folded configuration also provides other advantages. Namely, the detent 1046 allows the stock 10 to be quickly folded and/or unfolded without requiring the step of operating another lever, lock or other component, thereby improving the ease of use of the stock 10. The detent 1046 also provides a secondary safety mechanism in the event the weapon is fired while the stock 10 is folded and a cheek riser 108 (see FIG. 9 for an illustration of a cheek riser 108) is in use. Specifically, if the weapon is fired under these conditions, the charging handle of the firearm may strike the cheek riser 108; here, the detent 1046 allows the folding stock assembly 104 to open (or unfold) upon being struck, thereby reducing the chances of the stock 10 breaking under these conditions. This safe-open mechanism may operate in conjunction with a cheek riser 108 that has a charging handle glance surface 108*a*, to be discussed in further detail in subsequent paragraphs of this document.

In some embodiments, the detent 1046 may be configured to allow the folding stock assembly 104 to be opened using the force of which a single thumb of an average adult user is capable.

Figure 7:
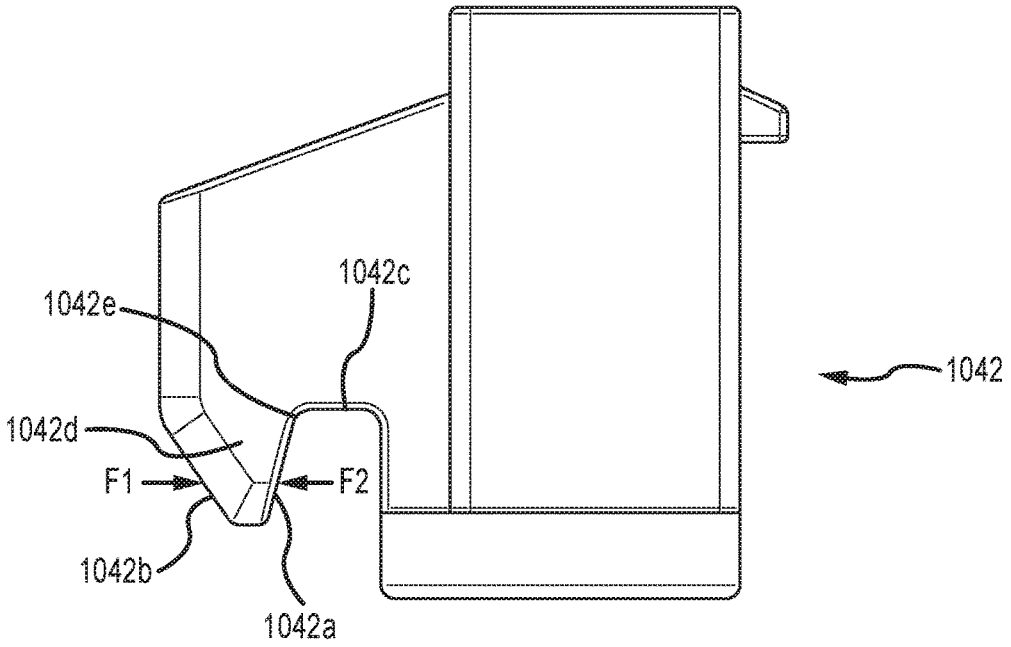
FIG. 7 is a top view of a lock according to an embodiment.
Figure 8:
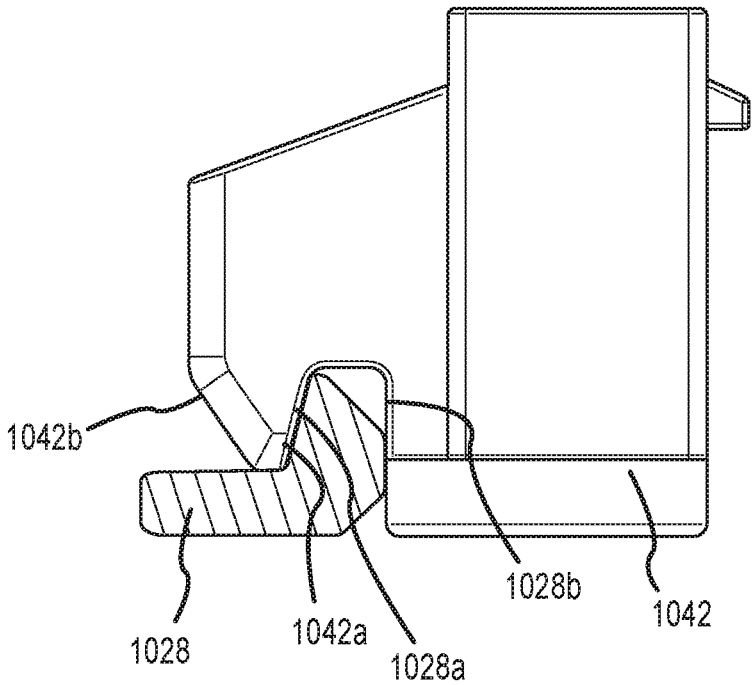
FIG. 8 is a top section view illustrating an engagement between a lock and a lock catch according to an embodiment.

Turning now to FIGS. 7-8, the lock 1042 is now discussed in further detail. In some embodiments, the lock 1042 may function similarly to a detent, in that the lock 1042 may translate laterally relative to the folding stock assembly 104 to snap into or unsnap from engagement with a lock catch 1028. The lock 1042 may be a button that is spring-biased towards a laterally extended position relative to a central portion of the folding stock assembly 104. The lock 1042 is shown in the laterally extended position in FIG. 2. The lock 1042 is shaped to engage the lock catch 1028 when the folding stock assembly is in the unfolded configuration, as shown in FIG. 8. The lock 1042 may be spring-biased to remain in the extended position unless expressly pressed inward towards the center of the folding stock assembly 104 by a user.

If the stock 10 is in the unfolded configuration, the lock 1042 may have a surface 1042*a* (see FIG. 7) shaped to engage a surface 1028*a* of the lock catch 1028 to prevent the stock 10 from being unintentionally folded. That is, the lock 1042 may prevent the stock 10 from being folded unless the lock 1042 is compressed.

In some embodiments, the minimum lateral force required to compress the lock 1042 may be chosen so as to ensure or limit the chance of accidental compression of the lock 1042. In some embodiments, a force required to compress the lock 1042 is greater than the weight of the stock 10 and the weapon to which the stock 10 is attached, so that laying the firearm down does not cause the lock 1042 to be unintentionally compressed.

Turning now to FIG. 8, the lock 1042 and lock catch 1028 are discussed in further detail. Notably, the lock 1042 may include a detent surface 1042*b* shaped to allow the lock 1042 to be compressed by a ledge 1028*b* of the lock catch 1028 as the folding stock assembly 104 is rotated into the unfolded configuration. After the stock assembly is moved into the unfolded configuration, the lock 1042 may snap back into the laterally extended position, as shown in FIG. 8.

To fold the stock 10, a user can press the lock 1042 inwardly, to provide a clearance between the lock 1042 and the lock catch 1028 to allow rotation.

In some embodiments, the lock 1042 comprises a safe-release mechanism. In these embodiments, the lock 1042 may be shaped to allow the stock 10 to be moved from the unfolded configuration without the user compressing or disengaging the lock 1042 (e.g., where the firearm is dropped or the stock 10 accidentally strikes a rigid object while in use). Specifically, and as is seen in FIG. 8, the lock surface 1042*a* and/or the lock catch ledge 1028*b* may be angled or beveled such that, at a high folding moment, the lock 1042 will disengage from the lock catch 1028, to allow folding, instead of breaking.

As will be apparent from a comparison between the detent surface 1042*b* and the lock surface 1042*a*, in some embodiments, a greater force is required to cause a safe-release of the lock 1042 than is required to engage the lock 1042 with the lock catch 1028. The high folding moment to cause the safe-release is significantly greater, in some embodiments at least an order of magnitude greater, than the unfolding moment to cause lock engagement in some embodiments.

Returning now to FIGS. 3B and 5, the stock-to-firearm interface 102 and/or the folding stock 102 may be shaped to limit the folding stock assembly 104 to rotational movement about a hinge axis. The hinge axis may be defined by a hinge 106, and, in some embodiments, the hinge axis is no more than 5 degrees from vertical, so as to limit the folding stock assembly 104 to rotation towards a side of the firearm and/or stock-to-firearm interface 102. In some embodiments, the folding stock assembly 104 is limited to rotation towards a right side of the firearm and/or stock-to-firearm interface 102.

Figure 6:
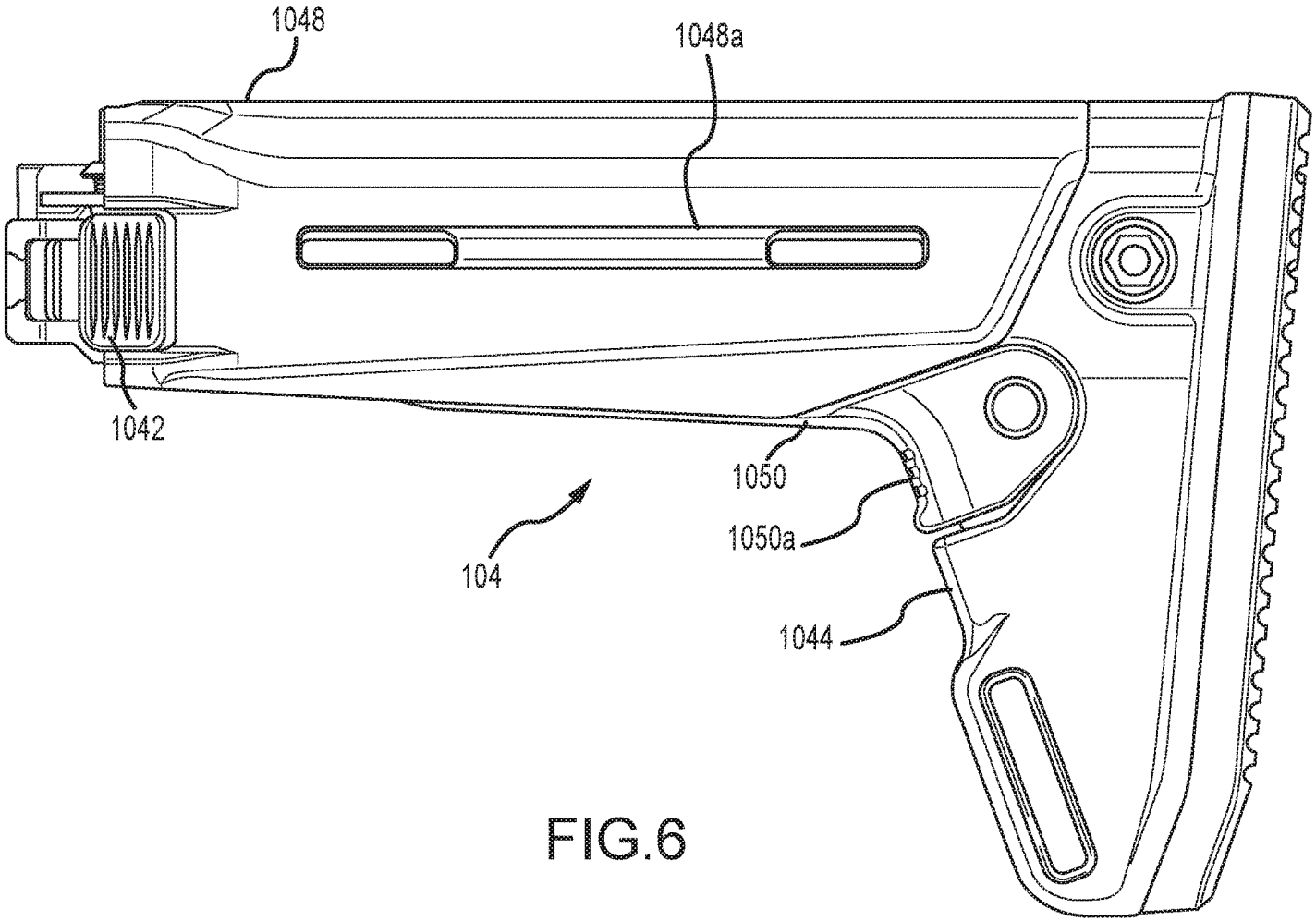
FIG. 6 is another side view of a folding stock assembly according to an embodiment.
Figure 9:
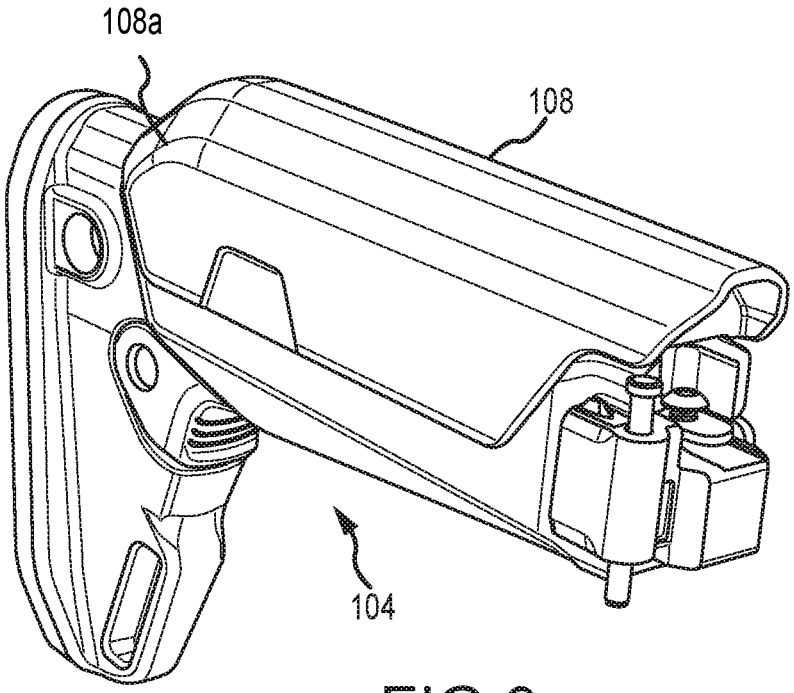
FIG. 9 is an isometric view of a folding stock assembly according to an embodiment.

Turning now to FIG. 9, in some embodiments, a cheek riser 108 may be coupled to the folding stock 104, to provide for improved sighting abilities for the user. To allow for a mounting of a cheek riser 108, the body 1048 of the folding stock assembly 104 may include a cheek riser mounting ledge 1048*a*, as seen in FIG. 6. In some embodiments, the cheek riser mounting ledge 1048*a* may comprise a window to allow viewing of the location of a length of pull feature. Returning to FIG. 9, one or more interchangeable cheek risers 108 of varying sizes may be available to fit to a particular user's anatomy or firing position, to improve sighting accuracy.

Figure 9A:
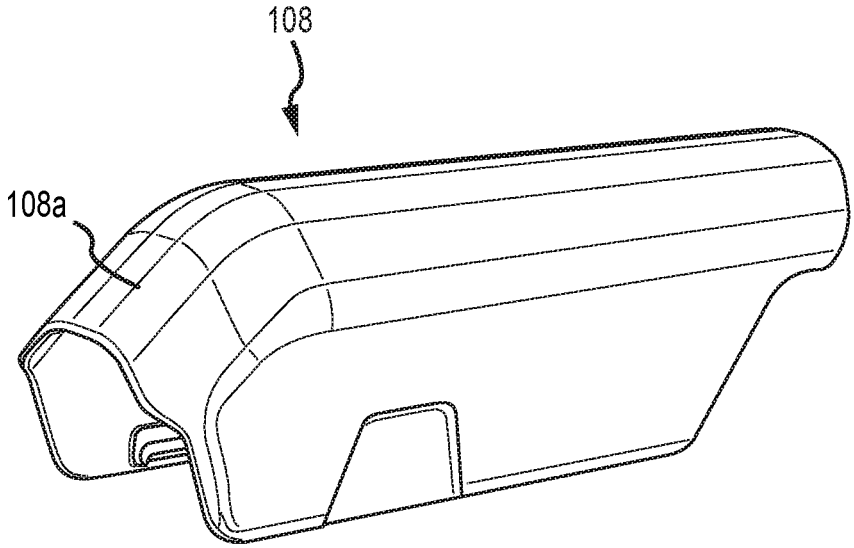
FIG. 9A is a side view of a cheek riser according to an embodiment.

Referencing now FIG. 9A, in some embodiments, the cheek riser 108 may include a charging handle glance surface 108*a*. The charging handle glance surface 108*a* may be provided as a safety mechanism for the case in which the weapon is fired while the stock 10 is folded, and a cheek riser 108 is present on the folding stock assembly 104. In such circumstances, the charging handle of the weapon will strike the cheek riser 108. To limit adverse effects from the strike, the charging handle glance surface 108*a* may be angled such that, instead of breaking the cheek riser 108 or folding stock assembly 104, the charging handle will glance the charging handle glance surface 108*a* to cause the cheek riser 108 and folding stock assembly 104 to unfold. Notably, the detent 1046 and detent catch 1024 may be shaped to limit the aggressiveness of the unfolding motion to a less dangerous motion (e.g., provide some resistance) as would otherwise be expected when the charging handle glance surface 108*a* is struck by the charging handle 201.

Figure 10:
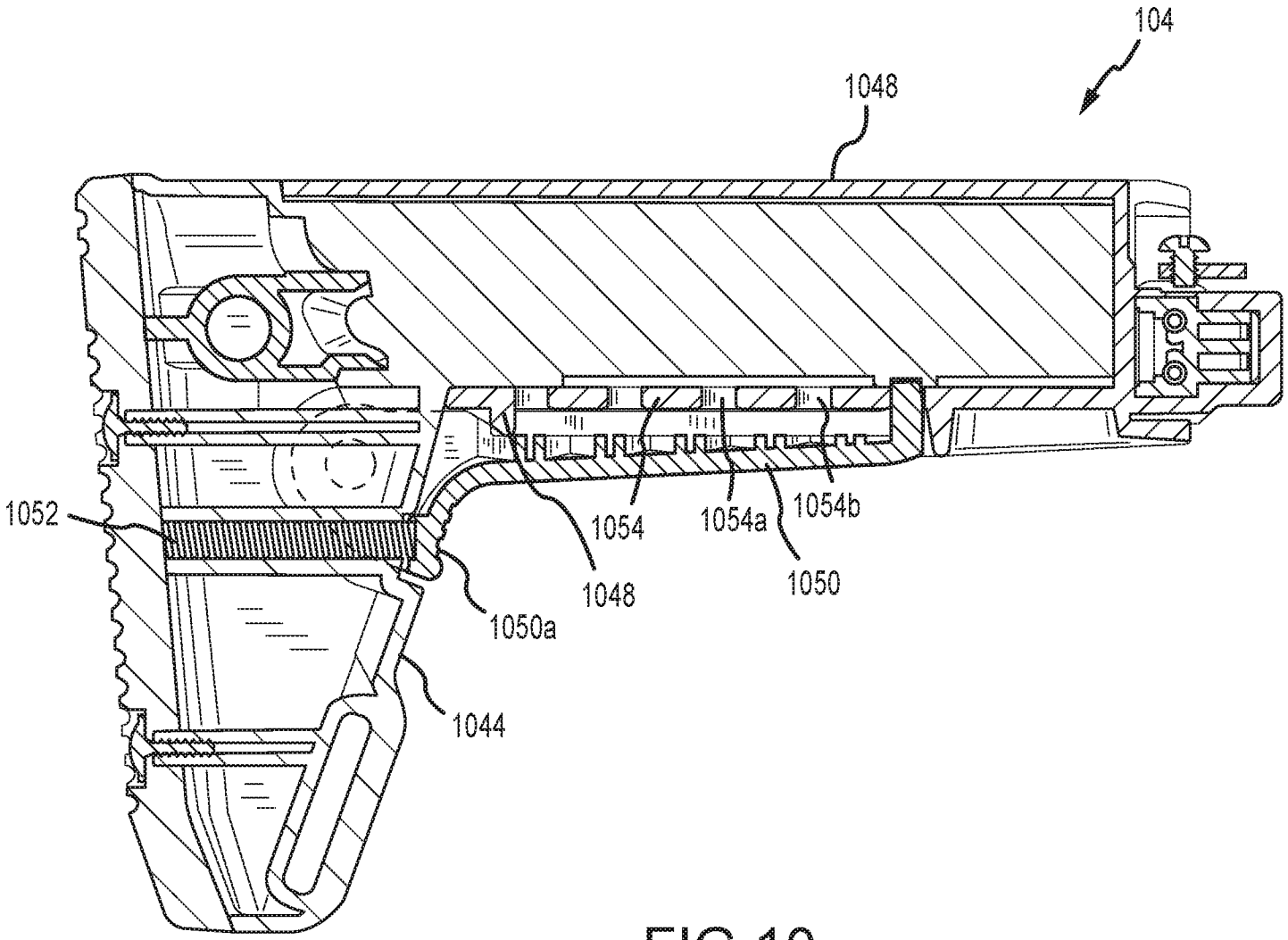
FIG. 10 is a side section view of a folding stock assembly according to an embodiment.

Referencing now FIG. 10, in some embodiments, the stock 10 may include a length of pull adjustment mechanism. The length of pull adjustment mechanism may have a lever 1050 and a length of pull adjustment rail 1054, with the lever hingedly mounted at a proximal portion of the folding stock assembly 104. The lever 1050 may be shaped to selectively and operatively engage the length of pull adjustment rail 1054 at any one of a plurality of adjustment recesses 1054*a*, 1054*b*. The length of pull adjustment mechanism may include a biasing spring 1052 to bias the lever 1050 towards engagement with a recess 1054*a* in the length of pull adjustment rail 1054.

The lever 1050 may be shaped to allow the lever 1050 to be disengaged from the length of pull adjustment rail 1054 by applying a gripping force at a proximal portion of the folding stock assembly 104. Here, the lever 1050 may have a finger engagement 1050*a*, seen most clearly in FIG. 6, positioned and shaped such that a user may wrap his or her hand about the buttstock 1044 (e.g., using the buttstock 1044 as a pistol grip) and apply an opening force to the lever 1050 at the finger engagement 1050*a*, so as to cause the lever 1050 to disengage from the recess 1054*a* and/or 1054*b*. In the same motion, or while maintaining compression on the finger engagement 1050*a* of the lever 1050, the user can pull proximally or push distally on the buttstock 1044 to cause the folding stock assembly 104 to move between an extended configuration and a retracted configuration. The extended configuration is exemplified in FIG. 1, while the contracted configuration is exemplified in FIG. 10. After the user releases compression on the lever 1050, the biasing spring 1052 is configured to bias the lever 1050 towards engagement with the nearest of the plurality of recesses 1054*a*. In some embodiments, the length of pull adjustment rail 1054 is unitary with the body 1048 of the folding stock assembly 104. Providing a length of pull adjustment mechanism as described above effectively eliminates the need for a "third hand" and improves the smoothness of motion for the user. When a plurality of recesses 1054*a* are used, there can be a length of pull position for each of the plurality of recesses 1054*a*. For instance, in FIG. 10, five recesses 1054*a* are shown, and thus five positions can be selected. Other numbers of selectable positions are also envisioned.

In some embodiments, the folding stock assembly 104, such as the body 1048 of the folding stock assembly 104 may have a travel stop 1048*a* to prevent the buttstock 1044 from being pulled out of the folding stock assembly 104. It should be understood that, although the travel stop 1048*a* is depicted as a component of the body 1048, the travel stop function can be achieved using any means known in the art.

Figure 11A:
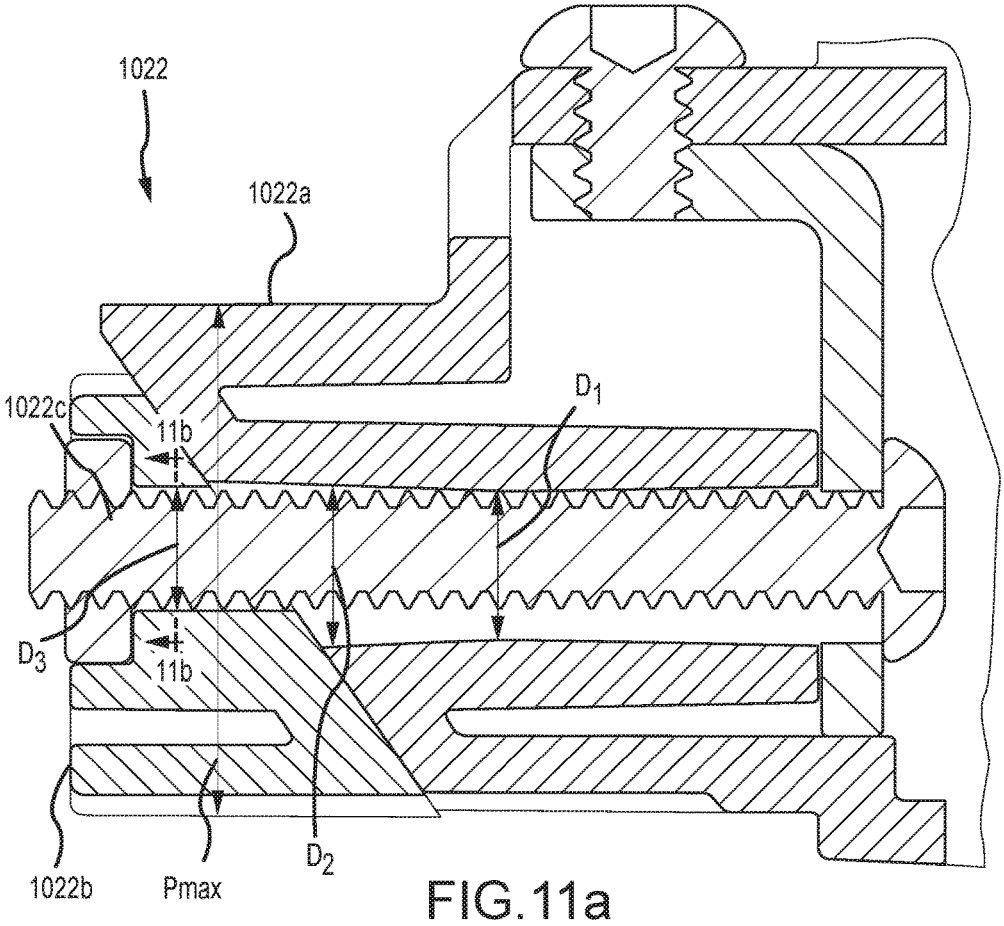
FIG. 11A is a side section view of a portion of a modifiable firearm mount according to an embodiment.
Figure 11B:
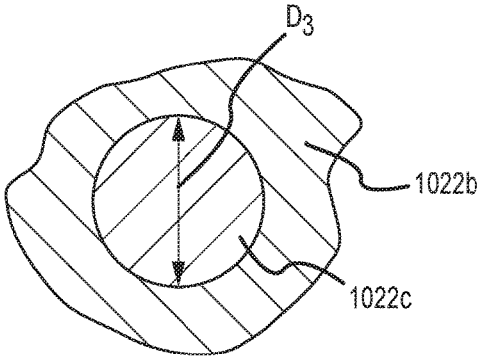
FIG. 11B is an end section view of a modifier body according to an embodiments.
Figure 11C:
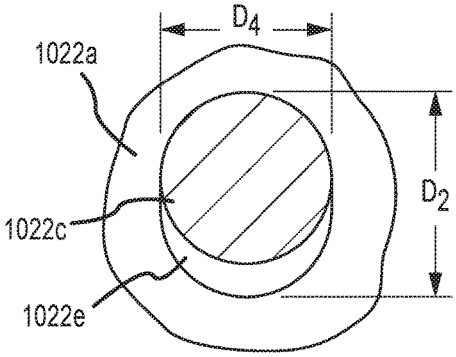
FIG. 11C is an end view of a primary mount body according to an embodiment.

Turning now to FIGS. 11A-11C, another feature of some embodiments of the modifiable firearm mount 1022 is now discussed. In these embodiments, and as is most clearly seen in FIG. 11A, a maximum profile Pmax of the modifiable firearm mount 1022 can be adjusted by providing a primary mount body 1022*a* with a fastener passage that does not have a consistent interior diameter. Instead, the fastener passage may have an interior passage having a first interior passage dimension D1 at a proximal region and a second interior passage dimension D2 at a distal region of the primary mount body 1022*a*. In some embodiments, D1 and D2 are of the same diameter, and may be oversized to allow a fastener extending therethrough to have both vertical and horizontal give.

In some embodiments, the primary mount body 1022*a* has a primary mount body passage 1022*e* that is circular, with D1 and D2 being different diameters, and D2 being greater than D1, while a threaded passage D3 in the modifier body 1022*b* has a third diameter (see FIG. 11B). The threaded passage D3 is smaller in diameter than D2. In these embodiments, it should be understood by one of skill in the art that adjustment of the fastener 1022*c* may cause the modifier body 1022*b* to move vertically relative to the primary mount body 1022*a*, while allowing for some "give" laterally when the stock 10 is attached to a firearm.

In some embodiments, the passage 1022*e* in the primary mount body 1022*a* is ovular or slotted at at least a distal portion of the primary mount body 1022*a*, as seen in FIG. 11C, which illustrates an end view of the primary mount body 1022*a*, with the fastener 1022*c* passing through. For instance, the passage 1022*e* can have a longer vertical diameter than a horizontal diameter. In these embodiments, the passage 1022*e* may have a slotted or ovular shape having a first interior dimension D4 defining a width and a second interior dimension D2 defining a height, with the width D4 being complementary to the diameter of the threaded diameter D3 of the modifier body 1022*b*, and the second interior dimension D2 being greater than the first interior dimension D4. In these embodiments, it should be understood by one of skill that adjustment of the fastener 1022*c* (e.g., rotation of a threaded fastener) will cause the modifier body 1022*b* to move laterally relative to a long axis of the firearm and vertically, but not side to side (left and right of the long axis of the firearm), relative to the primary mount body 1022*a*. In these embodiments, the modifier body 1022*b* can be adjusted to increase the maximum profile Pmax of the modifiable firearm mount 1022, so as to improve a fit with the firearm. In some embodiments, a proximal portion of the passage 1022*e* may be widened to improve manufacturability, such as by adding a draft angle for improving a molding process.

Put succinctly, the primary mount body 1022*a* can be manufactured to the smallest size expected across a variety of AK-47 style weapon manufacturers, and the modifier body 1022*b* can be adjusted to optimize the maximum profile Pmax to fit any of the AK-47 style firearms, regardless of manufacturer. The adjustment ridge(s) 1022*f* in the primary mount body 1022*a* can be filed to adjust a width to fit the recess of any AK-47 style firearm.

Figure 12:
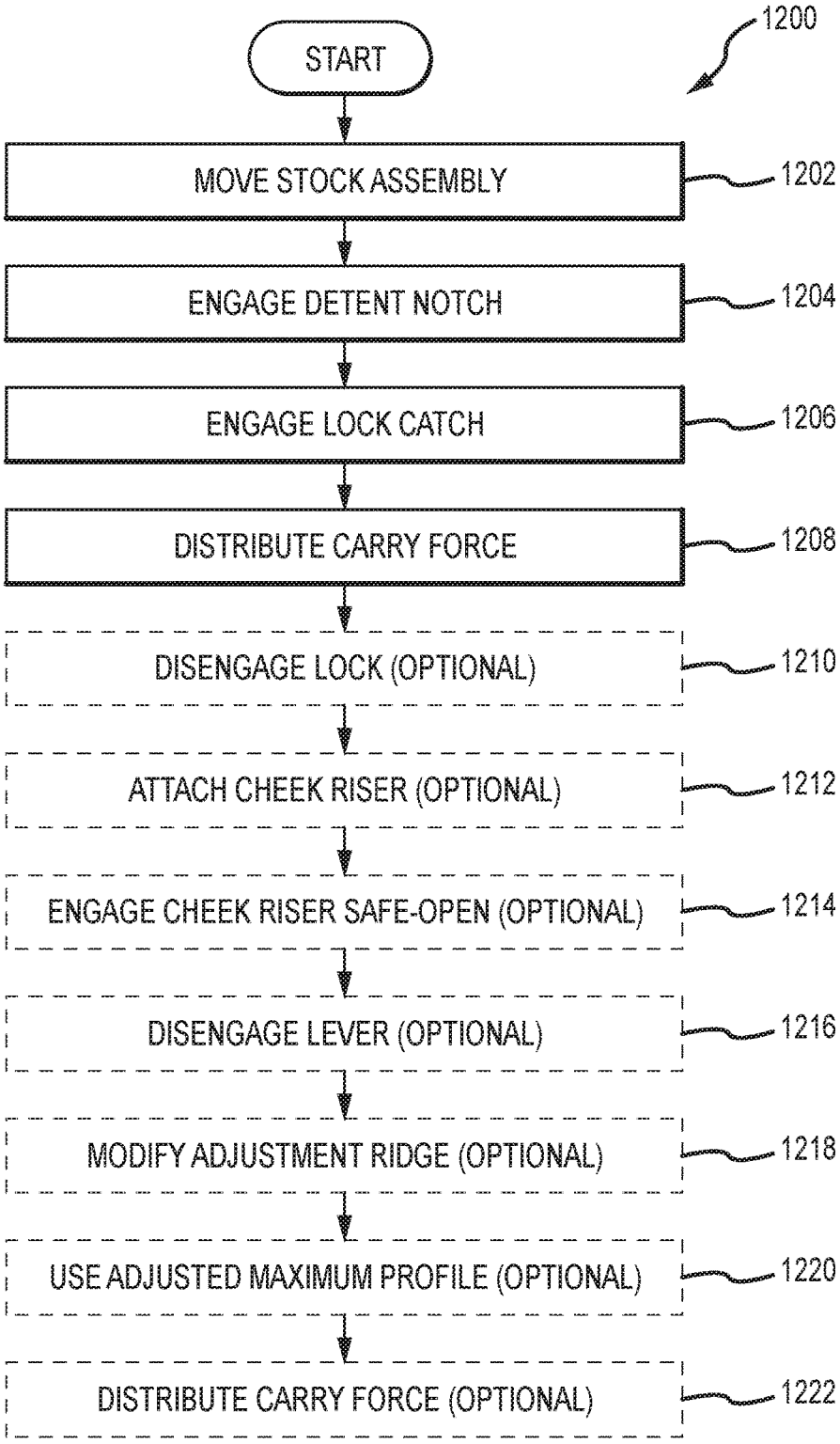
FIG. 12 is a flow diagram of a method according to an embodiment.

Turning now to FIG. 12, a method 1200 of using a stock assembly is now discussed. The method 1200 comprises: moving the stock assembly 1202, engaging a detent notch 1204, engaging a lock catch 1206, and distributing a carry force 1208. The method may be achieved using one or more of the embodiments described with reference to FIGS. 1-11C.

Moving the stock assembly 1202 comprises moving the stock assembly between a folded configuration and an unfolded configuration. In some embodiments, moving the stock assembly 1202 may include rotating a folding stock assembly about a hinge axis that is tilted no more than about 5 degrees relative to a vertical axis. In some embodiments, rotating may be about a pivot axis that is tilted no more than about 5 degrees from a vertical axis, without translation along the pivot axis.

Engaging a detent notch 1204 comprises causing a detent in a folding stock assembly of the stock assembly to engage a detent notch in a stock-to-firearm interface of the stock assembly to selectively maintain the stock assembly in the folded configuration.

Engaging a lock catch 1206 comprises causing a lock in the folding stock assembly to engage a lock catch in the stock-to-firearm interface to selectively maintain the stock assembly in the unfolded configuration.

Distributing a carry force 1208 comprises applying a carry force to a quick detach mount in the stock-to-firearm interface and causing the quick detach mount to distribute the carry force between a first surface of the stock-to-firearm interface and at least one of a second surface of the stock-to-firearm interface and a firearm receiver. Distributing a carry force 1208 may include engaging a plurality of inner surfaces of a stock-to-firearm interface using a quick detach mount having a plurality of engagement surfaces, each of the plurality of engagement surfaces having an average normal that is different from the average normal of each of the other engagement surfaces. Distributing a carry force 1208 may be achieved using, for example, the quick detach mount 1026 illustrated in FIG. 4.

The method 1200 may comprise disengaging the lock 1210 from the lock catch by compressing the lock towards a central portion of the folding stock assembly and/or disengaging the detent from the detent catch by applying an unfolding moment to move the stock assembly from a folding configuration to an unfolded configuration.

In some embodiments, disengaging the lock 1210 from the lock catch comprises applying a folding moment to the folding stock assembly without compressing the lock, wherein the folding moment is at least an order of magnitude greater than the unfolding moment, to move the stock assembly from the unfolded configuration.

The method 1200 may include engaging a cheek riser safe-open 1214. Engaging a cheek riser safe-open 1214 comprises attaching a cheek riser to the folding stock assembly; firing a weapon with the folding stock assembly attached in the folded configuration; and causing a charging handle of a weapon to strike the cheek riser, the charging handle further causing the stock assembly to unfold from the folded configuration without breaking the cheek riser.

The method 1200 may also include disengaging a lever 1216, wherein disengaging a lever 1216 comprises causing a lever to pivot about a transverse axis to disengage from a length of pull adjustment rail, wherein the transverse axis is in a proximal portion of the folding stock assembly.

The method 1200 may include modifying an adjustment ridge 1218, wherein modifying an adjustment ridge 1218 comprises removing a portion of an adjustment ridge of a primary mount body in the folding stock assembly to improve a fit between the folding stock assembly and a recess of a weapon.

The method 1200 may include using an adjusted maximum profile 1220, comprising using an adjusted maximum profile to improve a fit between the folding stock assembly and a recess of a weapon.

The method 1200 may include distributing a carry force 1222, comprising causing a single fastener to operatively couple a quick detach mount and a modifiable firearm mount; and distributing a majority of a carry force from a first surface of the modifiable firearm mount directly to one of a firearm receiver and a second surface of the modifiable firearm mount. Distributing a carry force 1222 may include distributing a majority of a carry force from a quick detach mount to a fastener and a modifiable firearm mount, the fastener coupling the quick detach mount and the modifiable firearm mount. Distributing a carry force 1222 may be achieved using, for example, the stock-to-firearm interface 102 illustrated in FIG. 3D.

Turning now to FIGS. 13A-16E, another embodiment of a stock assembly, a stock 20, is now discussed. The stock 20 has many features that are similar and/or related to the folded stock 10 discussed with reference to FIGS. 1-12. For example, the stock 20 has a stock-to-firearm interface 202 for mounting the stock 20 to a firearm, and a fixed stock 204.

Figure 13A:
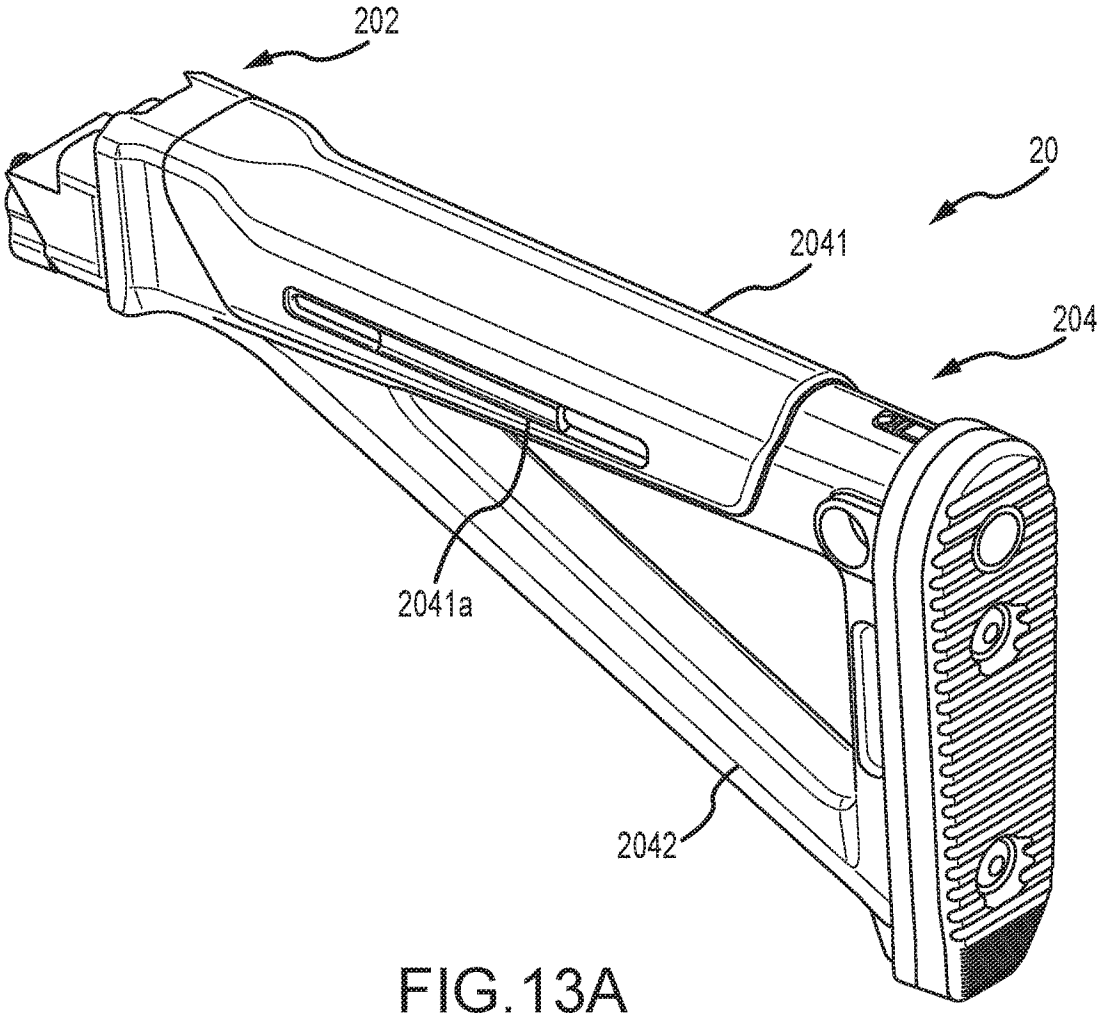
FIG. 13A is an isometric view of a stock according to another embodiment.
Figure 13B:
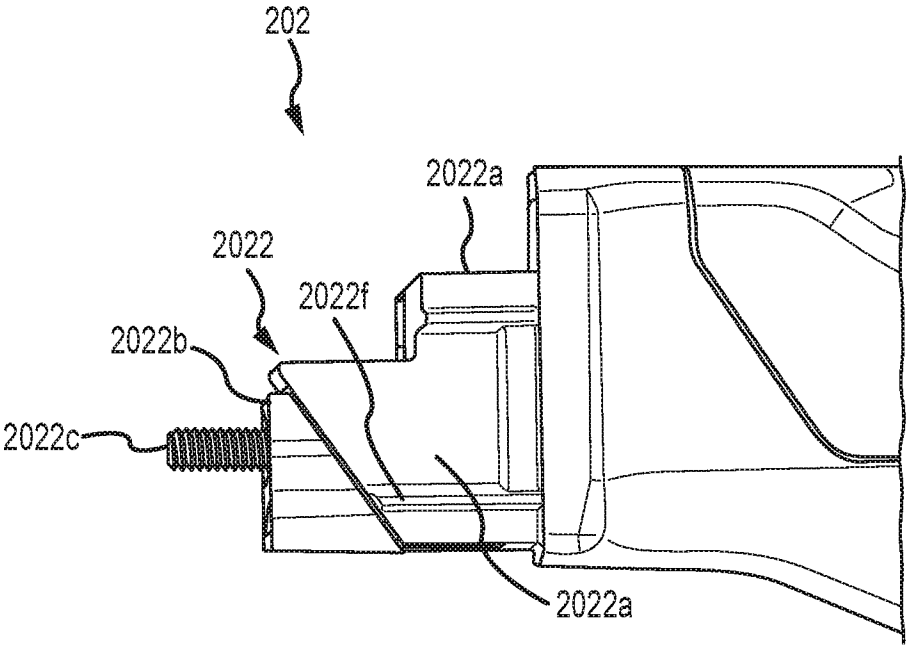
FIG. 13B is a side view of a stock-to-firearm interface in the stock illustrated in FIG. 13A.

In particular, and referencing FIG. 13A, the fixed stock 204 may have a cover 2041 and a main body 2042. The cover 2041 and main body 2042 may be unitary in some embodiments, or they may be separate features, as shown in FIG. 13A. The cover 2041 may have one or more cheek riser interfaces 2041*a* to receive a cheek riser 108 (see e.g. FIG. 9A), and/or the cover 2041 may be removable (see e.g. FIG. 15). A cheek riser for use with the stock 20 may be similar to the cheek riser 108 illustrated in FIG. 9A.

The stock-to-firearm interface 202 has many of the same features and functions as previously described with reference to FIGS. 3A-3C and FIGS. 11A-11C, without a folding feature. For example, and with reference to FIG. 13B, the stock-to-firearm interface 202 has a modifiable firearm mount 2022. The modifiable firearm mount 2022 may have a primary mount body 2022*a*, a modifier body 2022*b*, and a fastener 2022*c* for coupling the modifier body 2022*b* to the primary mount body 2022*a* in a manner similar to the modifiable firearm mount 1022 discussed with reference to stock 10 (see e.g. FIG. 3B). Moreover, the primary mount body 2022*a* and the modifier body 2022*b* may be adjustable relative to one another in a manner similar to that described with reference to FIGS. 11A-11C.

Specifically, with simultaneous reference to FIGS. 11A-11C and 13B, the stock-to-firearm interface 202, like the stock-to-firearm interface 102, has a modifiable firearm mount 1022, 2022. A maximum profile Pmax of the modifiable firearm mount 1022, 2022 can be adjusted by providing a primary mount body 1022*a*, 2022*a* with a fastener passage that does not have a consistent interior diameter. Instead, the fastener passage may have an interior passage having a first interior passage dimension D1 at a proximal region and a second interior passage dimension D2 at a distal region of the primary mount body 1022*a*, 2022*a*. In some embodiments, D1 and D2 are of the same diameter, and may be oversized to allow a fastener extending therethrough to have both vertical and horizontal give.

In some embodiments, the primary mount body 1022*a*, 2022*a* has a primary mount body passage 1022*e* that is circular, with D1 and D2 being different diameters, and D2 being greater than D1, while a threaded passage D3 in the modifier body 1022*b*, 2022*b* has a third diameter (see FIG. 11B). The threaded passage D3 is smaller in diameter than D2. In these embodiments, it should be understood by one of skill in the art that adjustment of the fastener 1022*c* may cause the modifier body 1022*b*, 2022*b* to move vertically relative to the primary mount body 1022*a*, 2022*a*, while allowing for some "give" laterally when the stock 10, 20 is attached to a firearm.

In some embodiments, the passage 1022*e* in the primary mount body 1022*a*, 2022*a* is ovular or slotted at at least a distal portion of the primary mount body 1022*a*, 2022*a*, as seen in FIG. 11C, which illustrates an end view of the primary mount body 1022*a*, 2022*a*, with the fastener 1022*c* passing through. For instance, the passage 1022*e* can have a longer vertical diameter than a horizontal diameter. In these embodiments, the passage 1022*e* may have an ovular or slotted shape having a first interior dimension D4 defining a width and a second interior dimension D2 defining a height, with the width D4 being complementary to the diameter of the threaded diameter D3 of the modifier body 1022*b*, 2022*b*, and the second interior dimension D2 being greater than the first interior dimension D4. In these embodiments, it should be understood by one of skill that adjustment of the fastener 1022*c* (e.g., rotation of a threaded fastener) will cause the modifier body 1022*b*, 2022*b* to move laterally relative to a long axis of the firearm and vertically, but not side to side (left and right of the long axis of the firearm), relative to the primary mount body 1022*a*, 2022*a*. In these embodiments, the modifier body 1022*b*, 2022*b* can be adjusted to increase the maximum profile Pmax of the modifiable firearm mount 1022, 2022, so as to improve a fit with the firearm. In some embodiments, a proximal portion of the passage 1022*e* may be widened to improve manufacturability, such as by adding a draft angle for improving a molding process.

Put succinctly, the primary mount body 1022*a*, 2022*a* can be manufactured to the smallest size expected across a variety of AK-47 style weapon manufacturers, and the modifier body 1022*b*, 2022*b* can be adjusted to optimize the maximum profile Pmax to fit any of the AK-47 style firearms, regardless of manufacturer. The adjustment ridge(s) 1022*f*, 2022*f* in the primary mount body 1022*a*, 2022*a* can be filed to adjust a width to fit the recess of any AK-47 style firearm.

The primary mount body 2022*a* may further include adjustment ridges 2022*f* which may be filed or otherwise removed to adjust a fit between the stock-to-firearm interface 202 and a firearm in a manner similar to that described with reference to stock 10.

Figure 14A:
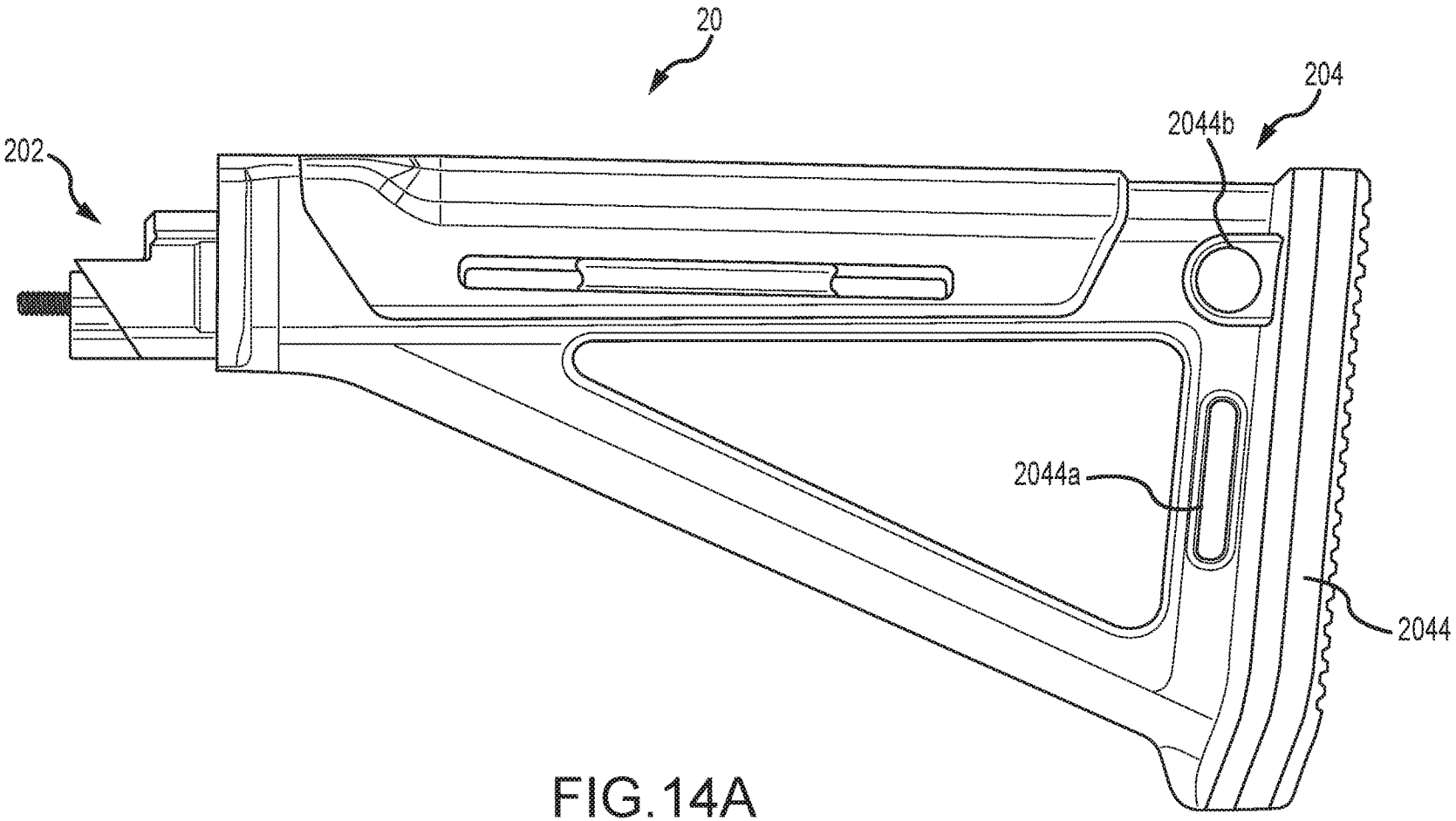
FIG. 14A is a left side view of the stock illustrated in FIG. 13A.
Figure 14B:
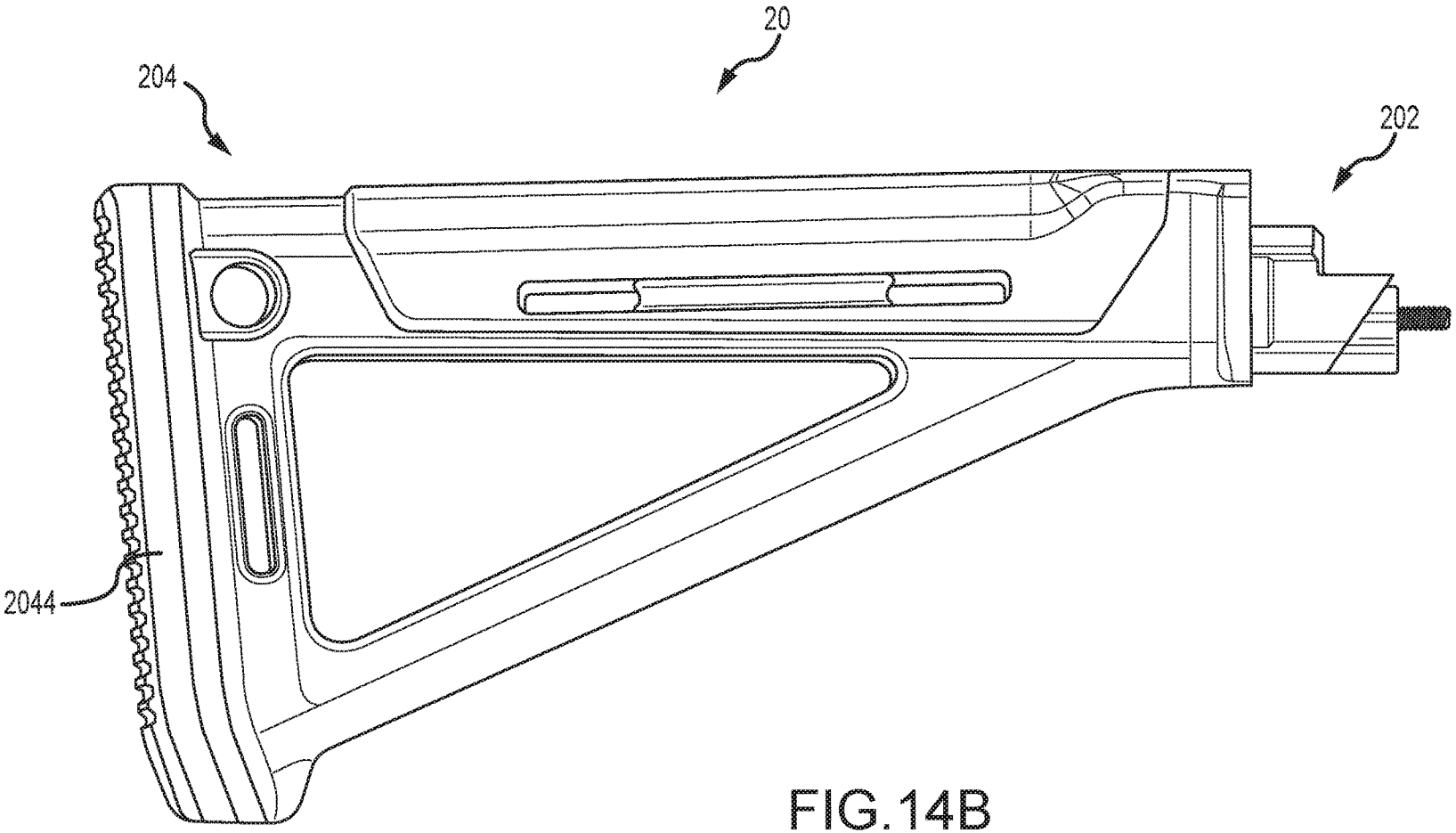
FIG. 14B is a right side view of the stock illustrated in FIG. 13A.

Turning now to FIGS. 14A-14B, which illustrate left and right side views of the stock 20 respectively, the stock 20 has a buttpad 2044 which may include an attachment point 2044*a*, such as a sling loop, and/or a mount interface 2044*b* for a QD socket as is known in the art.

Figure 15A:
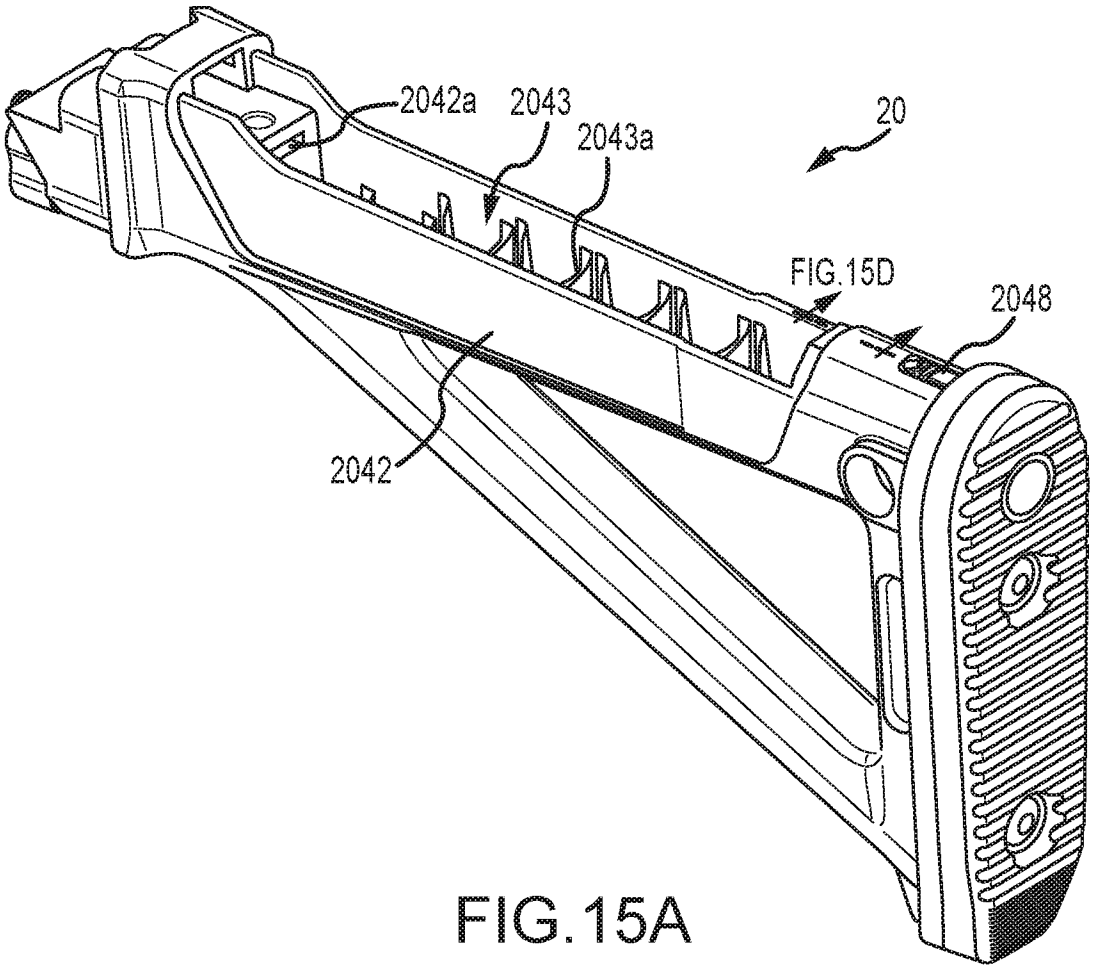
FIG. 15A is an isometric view of a stock according to another embodiment.
Figure 15B:
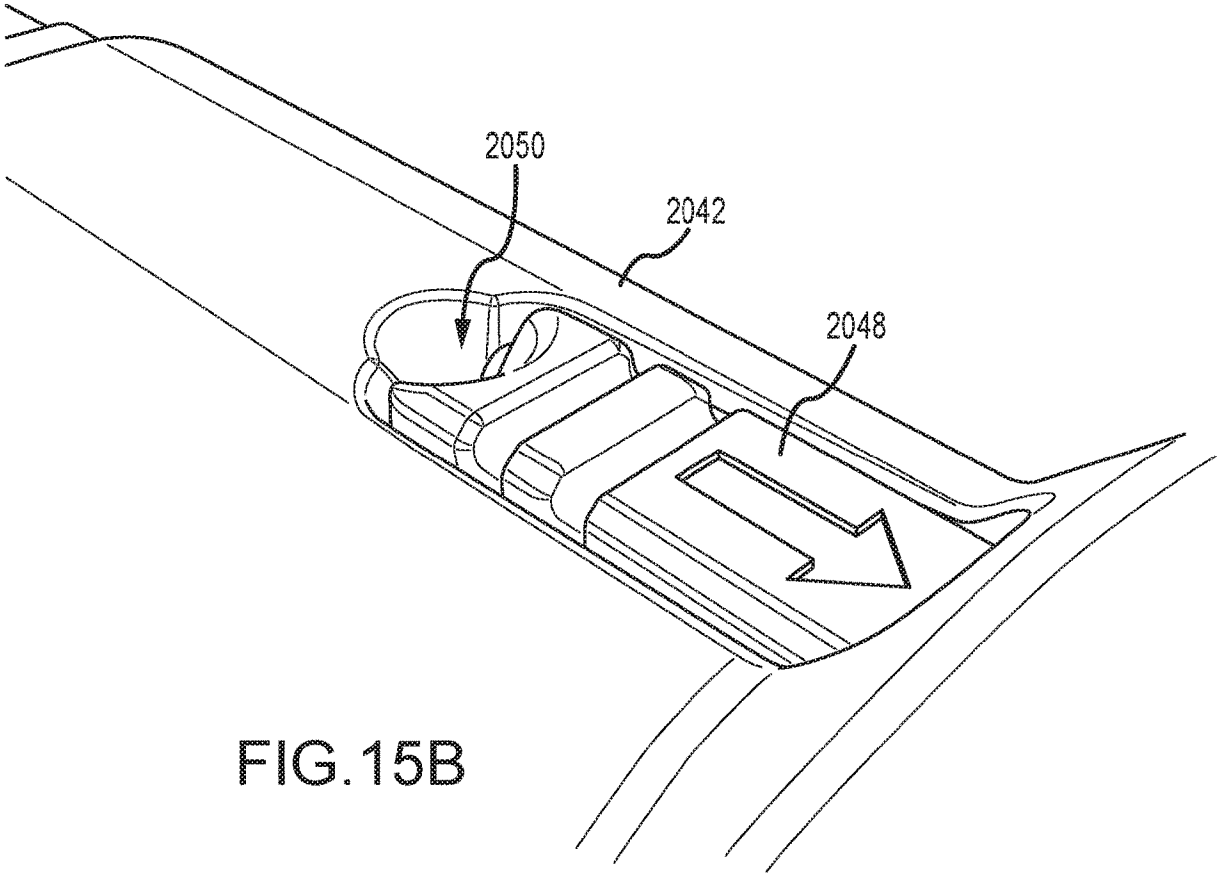
FIG. 15B is a detailed isometric view of a locking tab according to some embodiments.
Figure 15C:
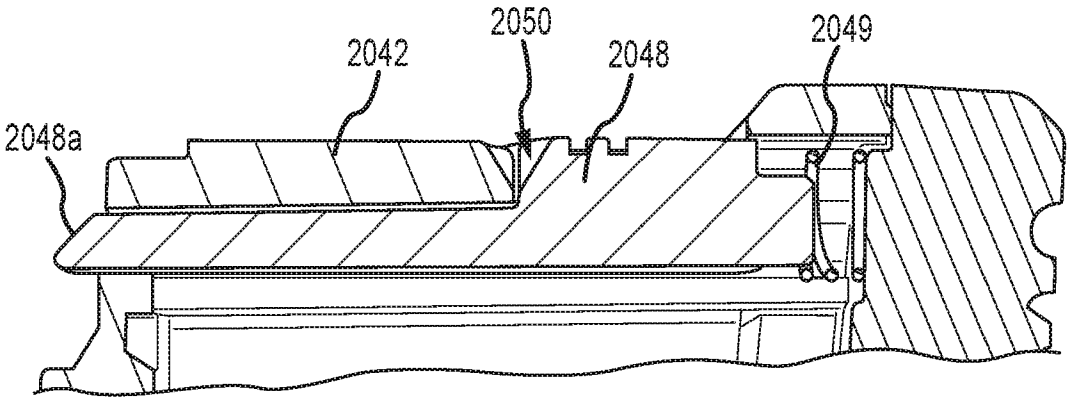
FIG. 15C is a detailed side section view of the locking tab illustrated in FIG. 15B.
Figure 15D:
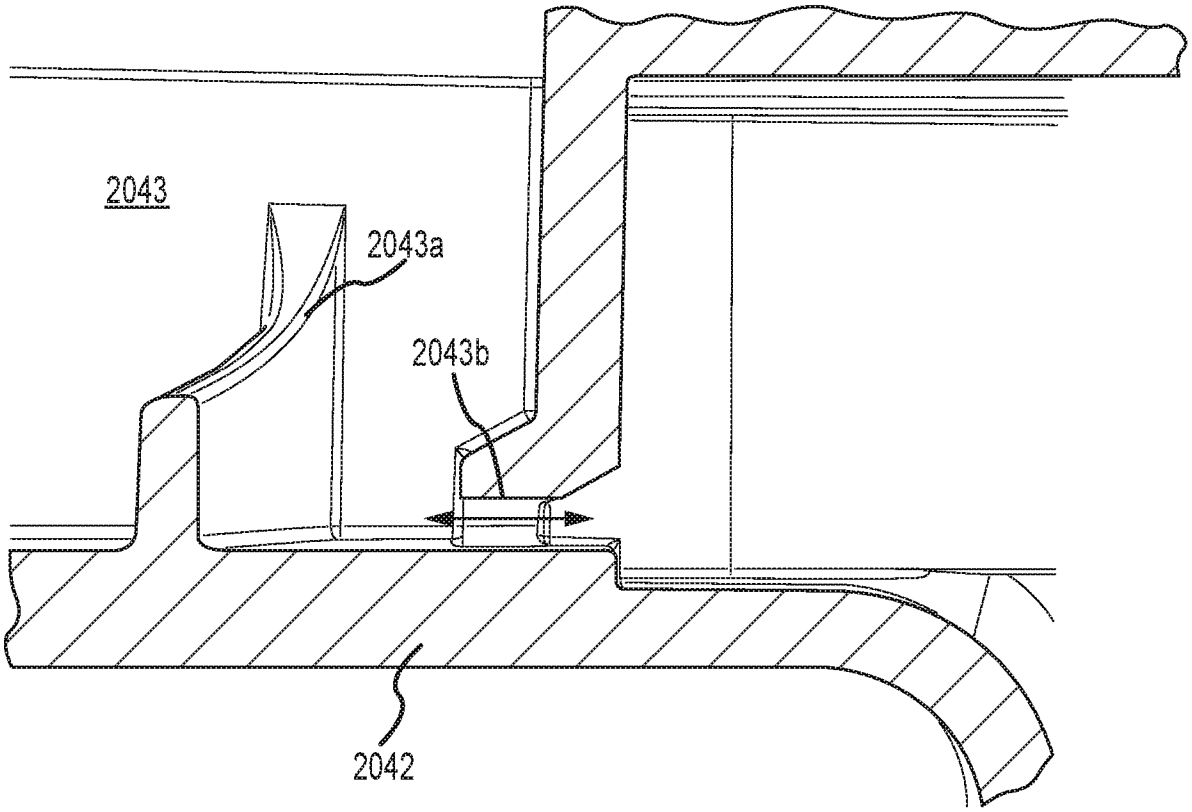
FIG. 15D is a detailed side section view of a drain according to some embodiments.

Turning now to FIGS. 15A-15D, which illustrate the stock 20 with a cover 2041 removed, in some embodiments, the stock 20 may have a storage compartment 2043 enclosed by a main body 2042 of the stock 20. The storage compartment 2043 may be accessed by removing the cover 2041 (see e.g. FIG. 13A) from the main body 2042 in some embodiments. The storage compartment 2043 may have bracing 2043*a* for providing a plurality of smaller compartments and/or improving strength in the stock 20. The bracing 2043*a* may be perpendicular or at another angle relative to the longitudinal axis of the stock 20. As illustrated in FIG. 15D, the storage compartment 2043 may also have a drain 2043*b* for allowing debris and moisture to escape from the storage compartment 2043. It should be understood that the drain 2043*b* may be placed virtually anywhere in the storage compartment 2043.

Returning to FIGS. 15A and 15B, the main body 2042 may also have a distal recess 2042*a* and a proximal locking tab 2048 for removably receiving the cover 2041 (see also FIGS. 16A-16E). A cover removal recess 2050, most clearly seen in FIGS. 15B-15C, may provide access for a removal tool to move the locking tab 2048. Further details of the interface between the cover 2041 and the main body 2042 are described below, after a general description of the cover 2041.

Figure 16A:
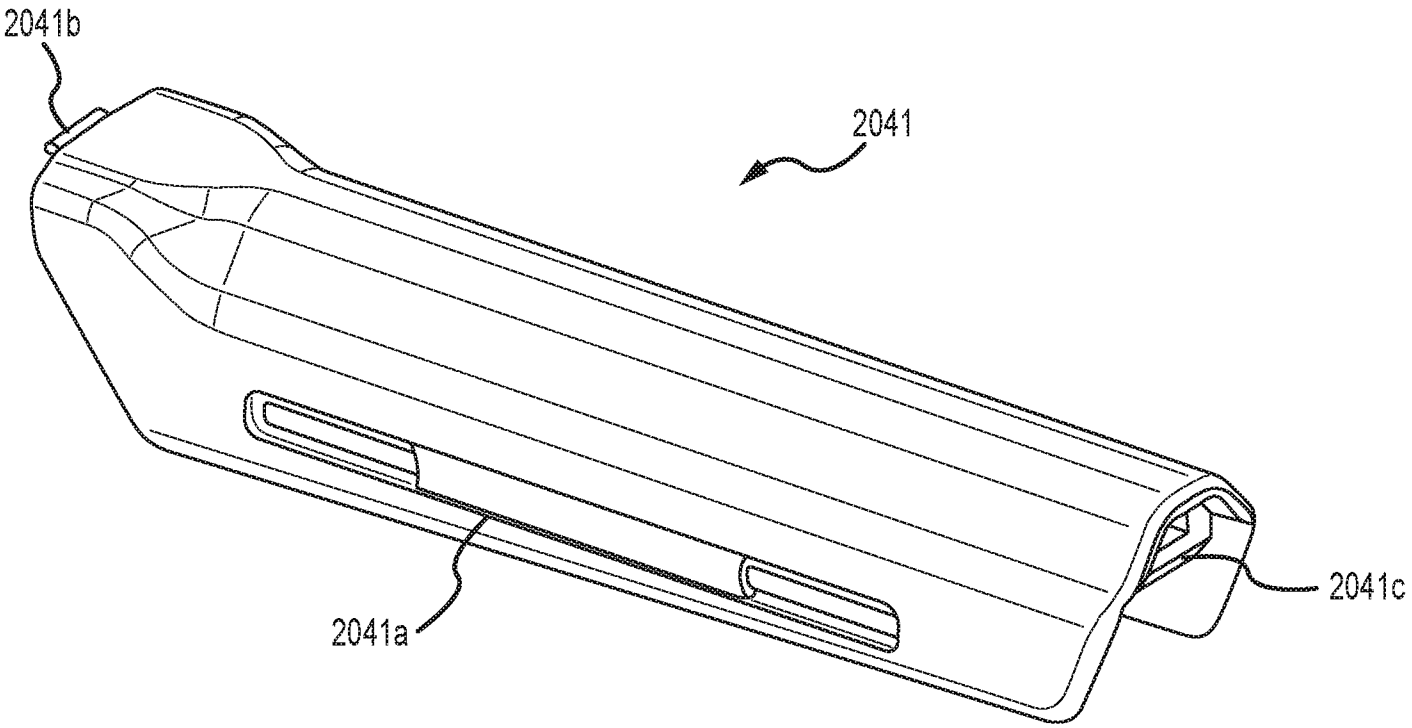
FIG. 16A is an isometric view of a cover according to some embodiments.
Figure 16B:
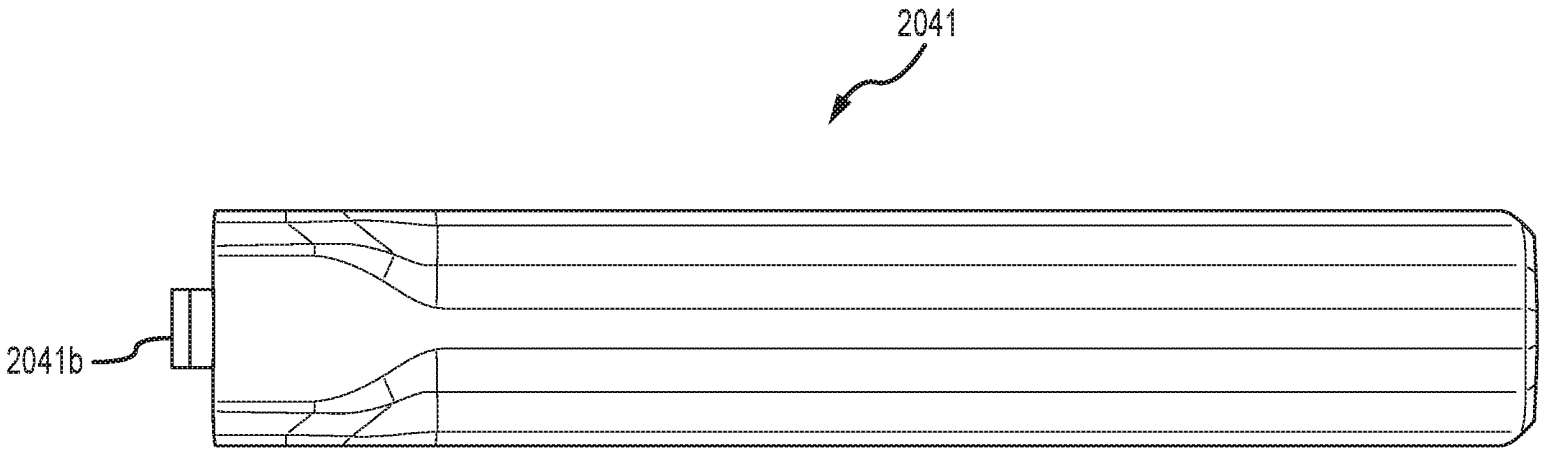
FIG. 16B is a top view of the cover illustrated in FIG. 16A.
Figure 16C:
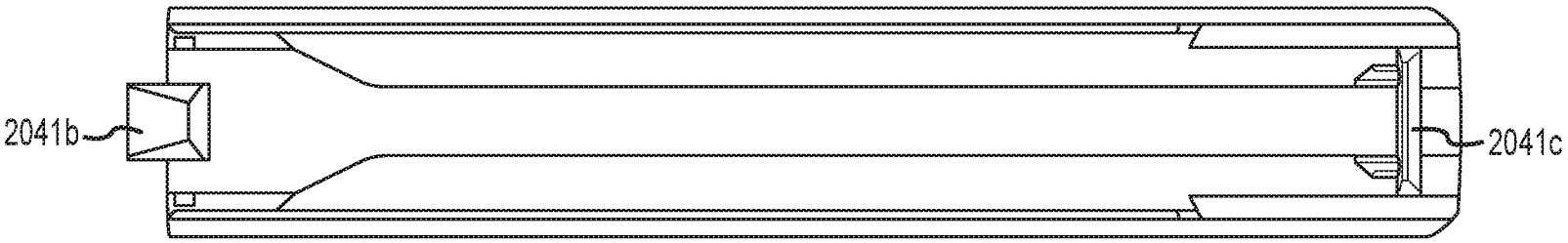
FIG. 16C is a bottom view of the cover illustrated in FIG. 16A.
Figure 16D:
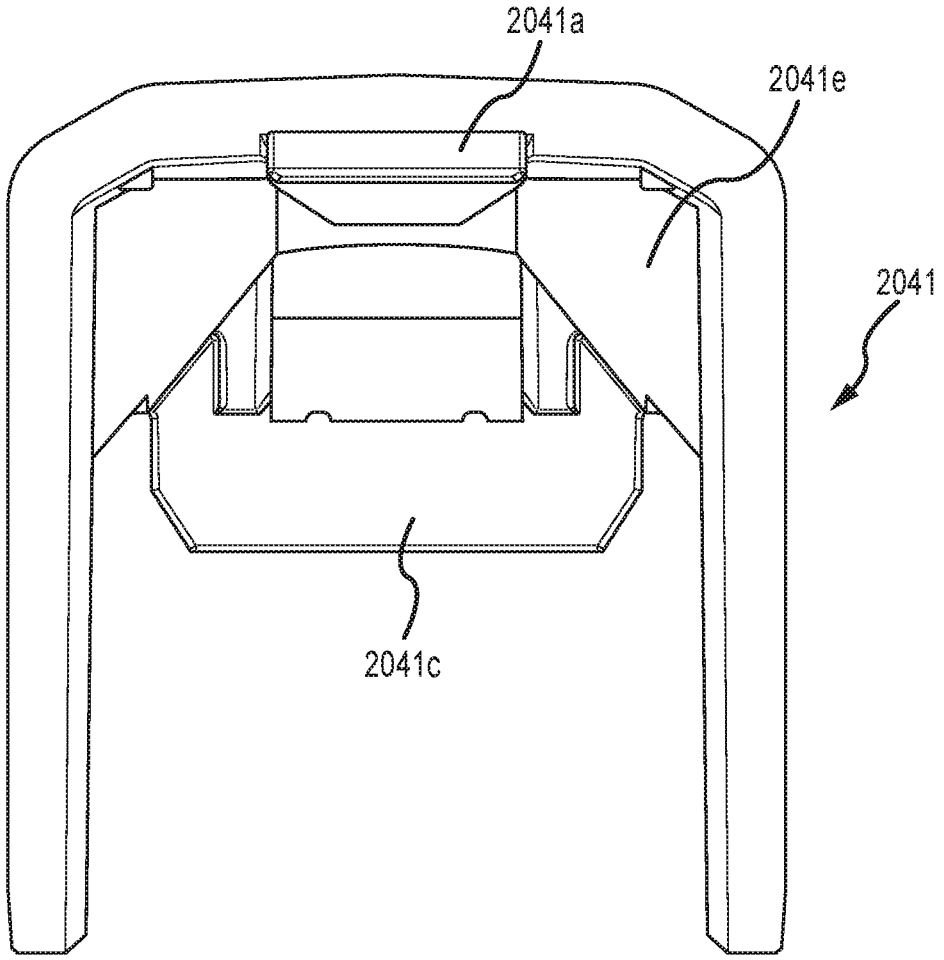
FIG. 16D is a front view of the cover illustrated in FIG. 16A.
Figure 16E:
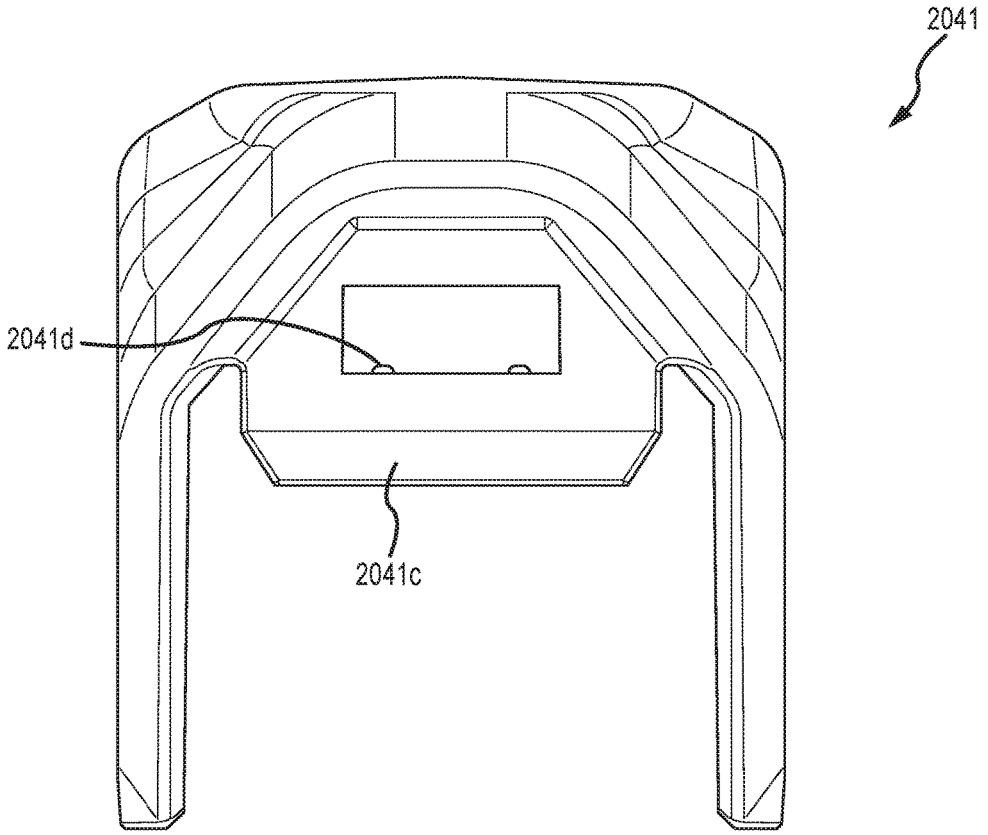
FIG. 16E is a back view of the cover illustrated in FIG. 16A.

Turning now to FIGS. 16A-16E, the cover 2041 is described in further detail. The cover 2041 may have a cheek riser interface 2041*a*, a distal coupling tab 2041*b*, and a proximal coupling recess 2041*c*. As seen in FIG. 16D, the cover 2041 may also have interior bracing 2041*e* for improving the strength and reliability of the cover 2041. The distal coupling tab 2041*b* and the proximal coupling recess 2041*c* may be used to attach the cover 2041 to a main body 2042.

Specifically, to attach the cover 2041 to the main body 2042, the user may insert the coupling tab 2041*b* into the recess 2042*a* in the main body 2042, and then snap the cover 2041 into place by pushing down on the cover 2041. Pushing down may cause the locking tab 2048 to retract or move proximally, thereby allowing the cover 2041 to be pushed into place.

Returning now to FIG. 15C, the locking tab 2048 may be moved proximally to a proximal or unlocked position in response to a downward pressure on an angled face 2048*a* which overcomes a lateral biasing force from a biasing mechanism 2049, such as a spring, that generally maintains the locking tab 2048 in a distal or locking position. After the cover 2041 is pushed into place, the biasing mechanism 2049, may cause the locking tab 2048 to move distally to return to the locking position.

Upon returning to the locking position, the locking tab 2048 is engaged with the coupling recess 2041*c* of the cover 2041, preventing the cover 2041 from disengaging from the main body 2042.

With reference to FIG. 15B, to remove the cover 2041 from the main body 2042, a user may insert a tip of his or her finger into a cover removal recess 2050 and manually move the locking tab 2048 proximally, thereby disengaging the locking tab 2048 from the cover 2041. In some embodiments, a removal tool, such as an improvised removal tool such as a cartridge tip, may be inserted instead. The cover 2041 may then be lifted away from the main body 2042, first at a proximal end having the recess 2041*c*, then at a distal end having the tab 2041*b*. The recess 2050 may be partially in the locking tab 2048 and partially in the cover 2042, or the recess 2050 may be wholly in the locking tab 2048.

Returning now to FIGS. 16D and 16E, the coupling recess 2041*c* may have one or more ridges 2041*d*. The ridges 2041*d* may provide for reduced friction between the locking tab 2048 and the coupling recess 2041*c* to improve reliability in the locking feature. The ridges 2041*d* may reduce play between the locking tab 2048 and the cover 2041, and may allow clearance for dust or dirt to escape, as well as for adjustment in some embodiments. For example, a manufacturer may adjust the size of the ridges 2041*d* to improve a fit. This in turn provides a more consistent interface between the cover 2041 and the locking tab 2048.

Figure 17:
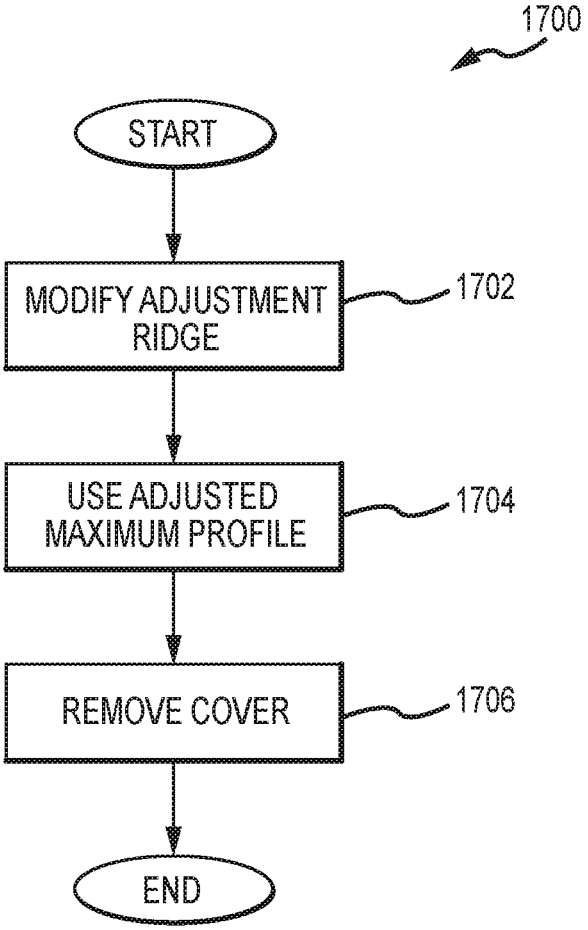
FIG. 17 is a flowchart of a method according to some embodiments.

Turning now to FIG. 17, a method of using a stock 1700 is now described. The method 1700 may include one or more of modifying an adjustment ridge 1702, using an adjusted maximum profile 1704, and removing a cover 1706 from a storage compartment.

Modifying an adjustment ridge 1702 may comprise removing a portion of an adjustment ridge of a primary mount body in the stock assembly to improve a fit between the stock assembly, such as stock 20, and a recess of a weapon.

The method 1700 may include using an adjusted maximum profile 1704, comprising using an adjusted maximum profile to improve a fit between the stock assembly, such as stock 20, and a recess of a weapon.

The method 1700 may include removing a cover 1706 from a storage compartment. Removing a cover 1706 may further include retracting a locking tab, lifting a proximal portion of a cover, and extracting a distal tab from a main body of a stock. Retracting a locking tab may include using a user's finger or an improvised removal tool to overcome a biasing force to move the locking tab from a lock position to an unlock position. Removing a cover 1706 may further include allowing the locking tab to return to a lock position.

The method 1700 may further include attaching a cover, as described with reference to FIGS. 13A-16E.

The method 1700 may further include storing an object within a storage compartment in the stock. The method 1700 may be accomplished using, for example, stock 20 described with reference to FIGS. 13A-16E.

In conclusion, the present invention provides, among other things, a system and method for using a stock assembly for a firearm. Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

What is claimed is:

1. A stock for a firearm, comprising:

a distal portion for interfacing with a firearm, the distal portion comprising one of a lock catch or a lock and one of a detent or a detent notch distinct from the one of a lock catch or a lock; and a proximal portion, the proximal portion comprising the other one of a lock catch or a lock and the other one of a detent or a detent notch; wherein the stock comprises a folded configuration and an unfolded configuration;

the lock is shaped to engage the lock catch in response to an unfolding moment to selectively maintain the stock in the unfolded configuration;

the detent is shaped to engage the detent notch to selectively maintain the stock in the folded configuration; and the lock comprises a safe-release mechanism to allow the folding stock to move into the folded configuration from the unfolded configuration when a folding moment is applied to the stock when the lock is engaged with the lock catch, the folding moment at least an order of magnitude greater than the unfolding moment.

2. The stock of claim 1, wherein:

the detent is a spring-biased translational detent;

and the lock is a spring-biased button shaped to travel in a direction different from a direction of travel of the detent.

3. The stock of claim 2, wherein:

the button engages the lock catch when the stock is in the unfolded configuration; and the button is shaped to disengage from the lock catch when the button is compressed into the proximal portion.

4. The stock of claim 3, wherein:

the button is spring-biased towards the extended position, and comprises an angled surface to engage an angled lock catch surface of the lock catch, whereby the button is shaped to auto-disengage from the lock catch when the stock is forcibly moved from the unfolded configuration.

5. The stock of claim 1, wherein:

the safe-release mechanism has a first lock catch engagement surface and a second lock catch engagement surface; and the first lock catch engagement surface is shaped to cause the lock to compress as the stock is moved into the unfolded configuration, the first lock catch engagement surface having an angle further shaped to cause the lock to compress under a first force;

the second lock catch engagement surface is shaped to cause the lock to compress as the stock is moved from the unfolded configuration into the folded configuration, the second lock catch engagement surface having an angle further shaped to cause the lock to compress under a second force, the second force greater than the first force.

6. The stock of claim 1, wherein:

the distal portion comprises a longitudinal axis and a vertical axis;

the proximal portion is rotatably coupled to the distal portion;

the proximal portion configured to rotate about an axis that is tilted no more than 5 degrees relative to the vertical axis.

7. The stock of claim 1, wherein:

the detent and the detent catch are shaped to provide resistance to unfolding.

8. The stock of claim 1, further comprising:

a cheek riser removably attached to the proximal portion, the cheek riser comprising a charging handle glance surface, the glance surface angled relative to at least one of a longitudinal axis or a vertical axis of the proximal portion.

9. The stock of claim 1, wherein the proximal portion further comprises:

a length of pull adjustment mechanism having a lever and a length of pull adjustment rail, the lever shaped to selectively engage the length of pull adjustment rail at any one of a plurality of adjustment recesses in the length of pull adjustment rail.

10. The stock of claim 9, wherein:

the lever is shaped to disengage from the length of pull adjustment rail in response to a longitudinal force on the lever.

11. The stock of claim 10, wherein:

the longitudinal force causes the lever to rotate about a transverse hinge, whereby the lever is disengaged from the length of pull adjustment rail.

12. The stock of claim 1, wherein:

the distal portion comprises a modifiable firearm mount having a primary mount body, a modifier body, and a fastener;

the primary mount body and the modifier body are shaped to fit within a recess of a receiver of a firearm; and the fastener adjustably and operatively couples the modifier body to the primary mount body to adjust a maximum insert profile.

13. The stock of claim 12, wherein:

the fastener further couples a quick detach mount to the primary mount body.

14. The stock of claim 12, wherein:

the primary mount body comprises an angled distal surface; and the modifier body comprises an angled proximal surface shaped to translate across the angled distal surface between a retracted position and an extended position relative to the primary mount body; and wherein the maximum insert profile is defined by the primary mount body when the modifier body is in the retracted position; and the maximum insert profile is defined by the primary mount body and the modifier body when the modifier body is in the extended position.

15. A method of using a stock for a firearm, the method comprising:

applying an unfolding moment to a folding stock to move the folding stock from a folded configuration to an unfolded configuration;

causing a detent to engage a detent notch to selectively maintain the folding stock in the folded configuration; and causing a lock to engage a lock catch to selectively maintain the folding stock in the unfolded configuration, the lock and the lock catch distinct from the detent and the detent catch, the lock having a safe-release mechanism to allow the folding stock to move into the folded configuration from the unfolded configuration when a folding moment is applied to the folding stock when the lock is engaged with the lock catch; and applying a folding moment to the folding stock to move the folding stock into the folded configuration from the unfolded configuration without disengaging the lock from the lock catch, the folding moment at least an order of magnitude greater than the unfolding moment.

16. The method of claim 15, further comprising:

disengaging the lock from the lock catch by compressing the lock.

17. The method of claim 15, further comprising:

disengaging the detent from the detent catch by applying an unfolding moment to move the stock from a folded configuration to an unfolded configuration.

18. The method of claim 15, wherein:

the applying the folding moment and the applying the unfolding moment comprise rotating a proximal portion of the stock relative to a distal portion of the stock about a hinge axis without translating the proximal portion along the hinge axis; and wherein the hinge axis is tilted no more than 5 degrees from an axis that is vertical relative to a longitudinal axis of the distal portion.

* * * * *